US011356767B2

(12) United States Patent
Cho et al.

(10) Patent No.: US 11,356,767 B2
(45) Date of Patent: Jun. 7, 2022

(54) SPEAKER MODULE INCLUDING AIR ADSORPTION MEMBER, AND ELECTRONIC DEVICE INCLUDING THE SAME

(71) Applicant: SAMSUNG ELECTRONICS CO., LTD., Suwon-si (KR)

(72) Inventors: Joonrae Cho, Suwon-si (KR); Changshik Yoon, Suwon-si (KR); Myeungsoon Kim, Suwon-si (KR); Taeeon Kim, Suwon-si (KR); Myungcheol Lee, Suwon-si (KR); Byounghee Lee, Suwon-si (KR); Hochul Hwang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/909,460

(22) Filed: Jun. 23, 2020

(65) Prior Publication Data

US 2021/0037313 A1 Feb. 4, 2021

(30) Foreign Application Priority Data

Aug. 2, 2019 (KR) ..... 10-2019-0094581

(51) Int. Cl.

| | |
|---|---|
| ***H04R 1/28*** | (2006.01) |
| ***H04R 1/02*** | (2006.01) |
| ***H04R 9/06*** | (2006.01) |

(52) U.S. Cl.

CPC ..... *H04R 1/2834* (2013.01); *H04R 1/026* (2013.01); *H04R 9/06* (2013.01); *H04R 2499/11* (2013.01)

(58) Field of Classification Search

CPC ..... H04R 1/2834; H04R 1/026; H04R 9/06; H04R 2499/11; H04R 1/222;

(Continued)

(56) References Cited

U.S. PATENT DOCUMENTS

| | | | | |
|---|---|---|---|---|
| 9,749,735 | B1 * | 8/2017 | Silver | H04R 1/2811 |
| 2005/0152573 | A1 | 7/2005 | Suzuki | |

(Continued)

FOREIGN PATENT DOCUMENTS

| | | |
|---|---|---|
| CN | 201797596 | 4/2011 |
| CN | 201878319 | 6/2011 |

(Continued)

OTHER PUBLICATIONS

International Search Report dated Oct. 8, 2020 in counterpart International Patent Application No. PCT/KR2020/007981.

*Primary Examiner* — Tuan D Nguyen

(74) *Attorney, Agent, or Firm* — Nixon & Vanderhye P.C.

(57) ABSTRACT

In various embodiments, a speaker module includes: an air adsorption member, and an electronic device includes the speaker module. The speaker module may include a yoke defining one surface of the speaker module, a magnet attached to the yoke through a first surface of the magnet, a plate attached to a second surface of the magnet, a frame providing a lateral surface of the speaker module and combined with the yoke at a first end of the frame, a voice coil disposed to be spaced apart from the magnet, and a diaphragm combined with the voice coil at an inner surface of the diaphragm. At least one of the yoke, the magnet, the plate, and the frame may include at least a portion of an air adsorption member comprising an air adsorption material configured to adsorb air in the speaker module based on the diaphragm vibrating.

20 Claims, 22 Drawing Sheets

(58) Field of Classification Search
CPC ..... H04R 1/2876; H04R 1/08; H04R 1/021; H04R 7/04; H04R 7/14; H04R 9/025; H04R 1/288; H04R 1/1016; H04R 1/2811; H04R 7/02
See application file for complete search history.

(56) References Cited

U.S. PATENT DOCUMENTS

| | | | | |
|---|---|---|---|---|
| 2010/0150389 | A1 | 6/2010 | Sumiyama et al. | |
| 2010/0206658 | A1 | 8/2010 | Slotte | |
| 2010/0329494 | A1 | 12/2010 | Rouvala et al. | |
| 2015/0072723 | A1 | 3/2015 | Schöffmann et al. | |
| 2016/0309254 | A1 | 10/2016 | Lembacher et al. | |
| 2016/0345090 | A1* | 11/2016 | Wilk | B01D 53/04 |
| 2017/0064438 | A1* | 3/2017 | Wilk | H04R 1/2811 |
| 2017/0195781 | A1 | 7/2017 | Kang et al. | |
| 2018/0302731 | A1 | 10/2018 | Liu et al. | |
| 2019/0058935 | A1 | 2/2019 | Lembacher et al. | |
| 2020/0177979 | A1* | 6/2020 | Cho | H04M 1/0274 |
| 2021/0185447 | A1* | 6/2021 | Dang | H04R 7/06 |

FOREIGN PATENT DOCUMENTS

| | | | |
|---|---|---|---|
| JP | 2009-267581 | A | 11/2009 |
| KR | 10-2017-0081136 | | 7/2017 |

* cited by examiner

SPEAKER MODULE INCLUDING AIR ADSORPTION MEMBER, AND ELECTRONIC DEVICE INCLUDING THE SAME

CROSS-REFERENCE TO RELATED APPLICATION

This application is based on and claims priority under 35 U.S.C. § 119 to Korean Patent Application No. 10-2019-0094581, filed on Aug. 2, 2019, in the Korean Intellectual Property Office, the disclosure of which is incorporated by reference herein in its entirety.

BACKGROUND

Field

The disclosure relates to a speaker module including an air adsorption member capable of minimizing and/or air resistance to vibration of a diaphragm, and an electronic device including the speaker module.

Description of Related Art

With a great variety of portable electronic devices such as smart phones popularized, various modules that perform particular functions are being provided in the electronic devices. For example, the electronic device may include at least one speaker module for outputting sounds. The speaker module may convert an electrical signal generated at the electronic device into an audible sound signal through the vibration of a diaphragm and output the sound signal.

As the thickness of the electronic device becomes thinner, the speaker module as well needs to be thinner. When the speaker module becomes thin, a vibration space of the diaphragm may be narrowed. In addition, when the vibration space of the diaphragm is narrowed, the diaphragm may be limited in vibration due to the resistance of ambient air existing in the speaker module. This may cause the sound reproduction efficiency to be lowered. For example, when the vibration of the diaphragm is limited, the sound output through the speaker module may be reduced or the sound quality may be degraded.

SUMMARY

Embodiments of the disclosure may provide a speaker module including an air adsorption member that facilitates compression and relaxation of air and thereby minimizes and/or reduces air resistance to a diaphragm without limiting the vibration of the diaphragm. In addition, embodiments of the disclosure may provide an electronic device including the speaker module.

According to various example embodiments of the disclosure, a speaker module may include: a yoke defining one surface of the speaker module; a magnet attached to the yoke through a first surface of the magnet; a plate attached to a second surface of the magnet; a frame providing a lateral surface of the speaker module and combined with the yoke at a first end of the frame; a voice coil disposed to be spaced apart from the magnet; and a diaphragm combined with the voice coil at an inner surface of the diaphragm. In the speaker module, at least one of the yoke, the magnet, the plate, and the frame may be include at least a portion of an air adsorption member comprising an air adsorption material configured to adsorb air in the speaker module based on the diaphragm vibrating.

According to various example embodiments of the disclosure, an electronic device may include: a housing providing at least a part of a lateral surface of the electronic device; and a speaker module including a speaker accommodated in the housing. The speaker module may include: a yoke defining one surface of the speaker module; a magnet attached to the yoke through a first surface of the magnet; a plate attached to a second surface of the magnet; a frame providing a lateral surface of the speaker module and combined with the yoke at a first end of the frame; a voice coil disposed to be spaced apart from the magnet; and a diaphragm combined with the voice coil at an inner surface of the diaphragm. At least one of the yoke, the magnet, the plate, and the frame may be combined with at least a portion of an air adsorption member comprising an air adsorption material configured to adsorb air in the speaker module based on the diaphragm vibrating.

According to various example embodiments of the disclosure, at least some components of the speaker module may be formed of or combined with the air adsorption member, and therefore it is possible to minimize and/or reduce air resistance to the diaphragm and thereby output an optimum sound.

In addition, minimizing and/or reducing air resistance to the diaphragm of the speaker module may secure a reliable amplitude of the diaphragm and thereby improve a sound quality of a low frequency band.

BRIEF DESCRIPTION OF THE DRAWINGS

The above and other aspects, features and advantages of certain embodiments of the present disclosure will be more apparent from the following detailed description, taken in conjunction with the accompanying drawings, in which.

DETAILED DESCRIPTION

Various example, embodiments of the disclosure will be described in greater detail below with reference to the accompanying drawings.

The following description with reference to the accompanying drawings is provided to aid in understanding of various embodiments of the disclosure. It includes various details to assist in that understanding but these are to be regarded as merely examples. Accordingly, those of ordinary skill in the art will recognize that various changes and modifications of the various example embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used to enable understanding of the disclosure. Accordingly, it should be apparent to those skilled in the art that the following description of various example embodiments of the disclosure is provided for illustration purpose only and not for the purpose of limiting the disclosure.

It is to be understood that the singular forms "a," "an," and "the" include plural referents unless the context clearly dictates otherwise. Thus, for example, reference to "a component surface" includes reference to one or more of such surfaces.

Figure 1:
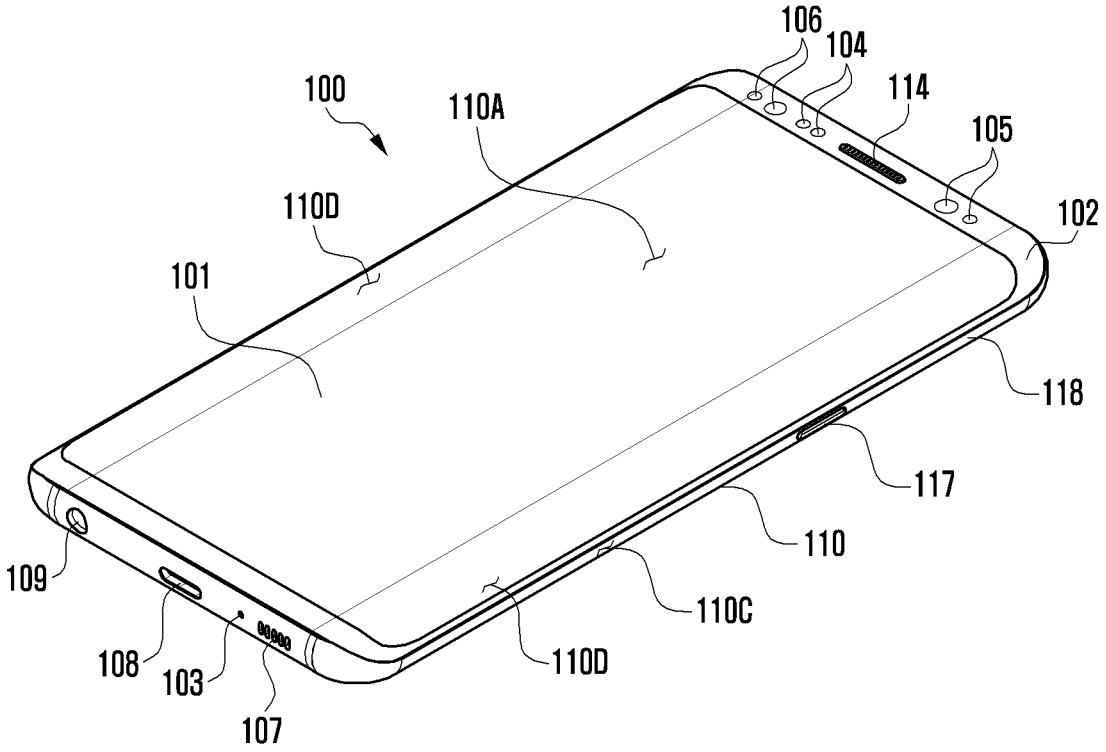
FIG. 1 is a perspective view illustrating a front surface of an example mobile electronic device according to an embodiment of the disclosure.

FIG. 1 is a perspective view illustrating a front surface of an example mobile electronic device according to an embodiment of the disclosure.

Figure 2:
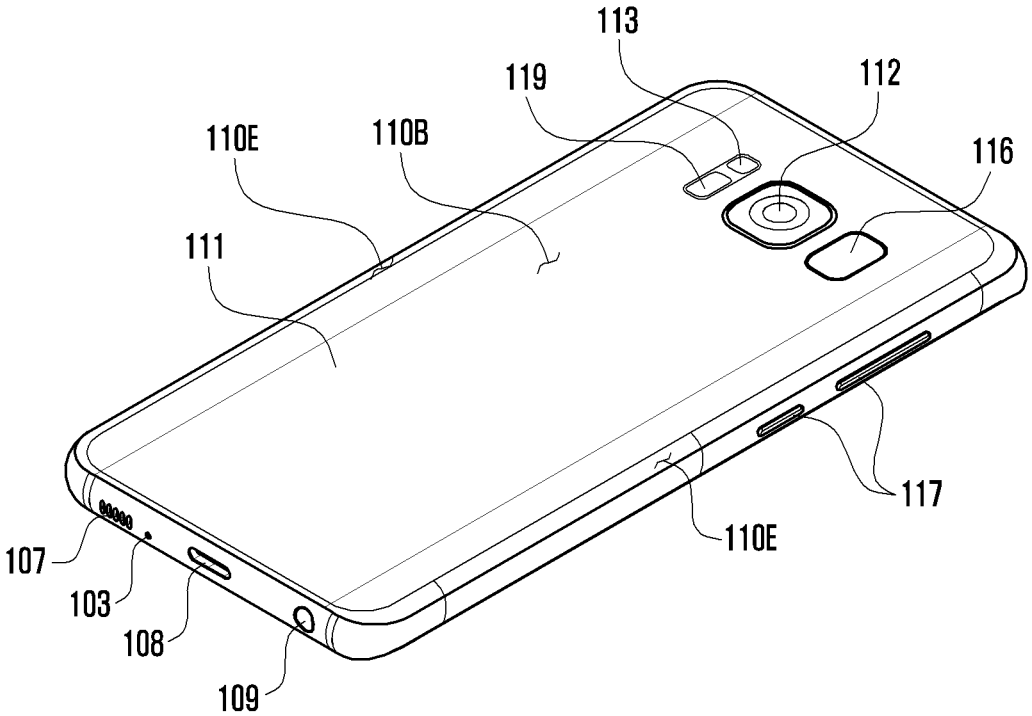
FIG. 2 is a perspective view illustrating a rear surface of the mobile electronic device shown in FIG. 1 according to an embodiment of the disclosure.

FIG. 2 is a perspective view illustrating a rear surface of the electronic device of FIG. 1 according to an embodiment of the disclosure.

Referring to FIG. 1 and FIG. 2, an electronic device 100 according to an embodiment may include a housing 110 including a first surface (or front surface) 110A, a second surface (or rear surface) 110B, and a side surface 110C surrounding the space between the first surface 110A and the second surface 110B. In another embodiment (not illustrated), the housing may denote a structure that forms a part of the first surface 110A, the second surface 110B, and the side surface 110C illustrated in FIG. 1. According to an embodiment, the first surface 110A may be formed by a front plate 102, at least a part of which is substantially transparent (for example, a glass plate including various coating layers, or a polymer plate). The second surface 110B may be formed by a rear plate 111 that is substantially opaque. The rear plate 111 may be made of coated or colored glass, ceramic, polymer, metal (for example, aluminum, stainless steel (STS), or magnesium), or a combination of at least two of the above-mentioned materials. The side surface 110C may be formed by a side bezel structure (or "side member") 118 which is coupled to the front plate 102 and to the rear plate 111, and which includes metal and/or polymer. In some embodiments, the rear plate 111 and the side bezel structure 118 may be formed integrally and may include the same material (for example, a metal material such as aluminum).

In the illustrated embodiment, the front plate 102 may include two first areas 110D on both ends of the long edge of the front plate 102 such that the two first areas 110D bend from the first surface 110A toward the rear plate 111 and extend seamlessly. In the illustrated embodiment (see FIG. 2), the rear plate 111 may include two second areas 110E on both ends of the long edge such that the two second areas 110E bend from the second surface 110B toward the front plate 102 and extend seamlessly. In some embodiments, the front plate 102 (or the rear plate 111) may include only one of the first areas 110D (or the second areas 110E). In another embodiment, a part of the first areas 110D or the second areas 110E may not be included. In the above embodiments, when seen from the side surface of the electronic device 100, the side bezel structure 118 may have a first thickness (or width) on a part of the side surface, which does not include the first areas 110D or the second areas 110E as described above, and may have a second thickness that is smaller than the first thickness on a part of the side surface, which includes the first areas 110D or the second areas 110E.

According to an embodiment, the electronic device 100 may include at least one of a display 101, audio modules 103, 107, and 114, sensor modules 104, 116, and 119, camera modules 105, 112, and 113, a key input device 117, a light-emitting element 106, and connector holes 108 and 109. In some embodiments, at least one of the elements (for example, the key input device 117 or the light-emitting element 106) of the electronic device 100 may be omitted, or the electronic device 100 may additionally include another element.

The display 101 may be exposed through a corresponding part of the front plate 102, for example. In some embodiments, at least a part of the display 101 may be exposed through the front plate 102 that forms the first areas 110D of the side surface 110C and the first surface 110A. In some embodiments, the display 101 may have a corner formed in substantially the same shape as that of the adjacent outer periphery of the front plate 102. In another embodiment (not illustrated), in order to increase the area of exposure of the display 101, the interval between the outer periphery of the display 101 and the outer periphery of the front plate 102 may be formed to be substantially identical.

In another embodiment (not illustrated), a recess or an opening may be formed in a part of the screen display area of the display 101, and at least one of an audio module 114, a sensor module 104, a camera module 105, and a light-emitting element 106 may be included and aligned with the recess or the opening. In another embodiment (not illustrated), on the back surface of the screen display area of the display 101, at least one of an audio module 114, a sensor module 104, a camera module 105, a fingerprint sensor 116, and a light-emitting element 106 may be included. In another embodiment (not illustrated), the display 101 may be coupled to or arranged adjacent to a touch sensing circuit, a pressure sensor capable of measuring the intensity (pressure) of a touch, and/or a digitizer that detects a magnetic field-type stylus pen. In some embodiments, at least a part of the sensor modules 104 and 119 and/or at least a part of the key input device 117 may be arranged in the first areas 110D and/or the second areas 110E.

The audio modules 103, 107, and 114 may include a microphone hole 103 and speaker holes 107 and 114. A microphone for acquiring an external sound may be arranged in the microphone hole 103, and a plurality of microphones may be arranged therein such that the direction of a sound can be sensed in some embodiments. The speaker holes 107 and 114 may include an outer speaker hole 107 and a speech receiver hole 114. In some embodiments, the speaker holes 107 and 114 and the microphone hole 103 may be implemented as a single hole, or a speaker may be included (for example, a piezoelectric speaker) without the speaker holes 107 and 114.

The sensor modules 104, 116, and 119 may generate an electric signal or a data value corresponding to the internal operating condition of the electronic device 100 or the external environment condition thereof. The sensor modules 104, 116, and 119 may include, for example, a first sensor module 104 (for example, a proximity sensor) arranged on the first surface 110A of the housing 110, and/or a second sensor module (not illustrated) (for example, a fingerprint sensor), and/or a third sensor module 119 (for example, an HRM sensor) arranged on the second surface 110B of the housing 110, and/or a fourth sensor module 116 (for example, a fingerprint sensor). The fingerprint sensor may be arranged not only on the first surface 110A (for example, the display 101) of the housing 110, but also on the second surface 110B thereof. The electronic device 100 may further include a sensor module not illustrated, for example, at least one of a gesture sensor, a gyro sensor, an atmospheric pressure sensor, a magnetic sensor, an acceleration sensor, a grip sensor, a color sensor, an infrared (IR) sensor, a biometric sensor, a temperature sensor, a humidity sensor, or a luminance sensor 104.

The camera modules 105, 112, and 113 may include a first camera device 105 arranged on the first surface 110A of the electronic device 100, a second camera device 112 arranged on the second surface 110B thereof, and/or a flash 113. The camera devices 105 and 112 may include a single lens or a plurality of lenses, an image sensor, and/or an image signal processor. The flash 113 may include, for example, a light-emitting diode or a xenon lamp. In some embodiments, two or more lenses (an infrared camera, a wide-angle lens, and a telephoto lens) and image sensors may be arranged on a single surface of the electronic device 100.

The key input device 117 may be arranged on the side surface 110C of the housing 110. In another embodiment, the electronic device 100 may not include a part of the above-mentioned key input device 117 or the entire key input device 117, and the key input device 117 (not included) may be implemented in another type, such as a soft key, on the display 101. In some embodiments, the key input device may include a sensor module 116 arranged on the second surface 110B of the housing 110.

The light-emitting element 106 may be arranged on the first surface 110A of the housing 110, for example. The light-emitting element 106 may provide information regarding the condition of the electronic device 100 in a light type, for example. In another embodiment, the light-emitting element 106 may provide a light source that interworks with operation of the camera module 105, for example. The light-emitting element 106 may include, for example, a light-emitting diode (LED), an infrared light-emitting diode (IR LED), and a xenon lamp.

The connector holes 108 and 109 may include a first connector hole 108 capable of containing a connector (for example, a universal serial bus (USB) connector) for transmitting/receiving power and/or data to/from an external electronic device, and/or a second connector hole (for example, an earphone jack) 109 capable of containing a connector for transmitting/receiving an audio signal to/from the external electronic device.

Figure 3:
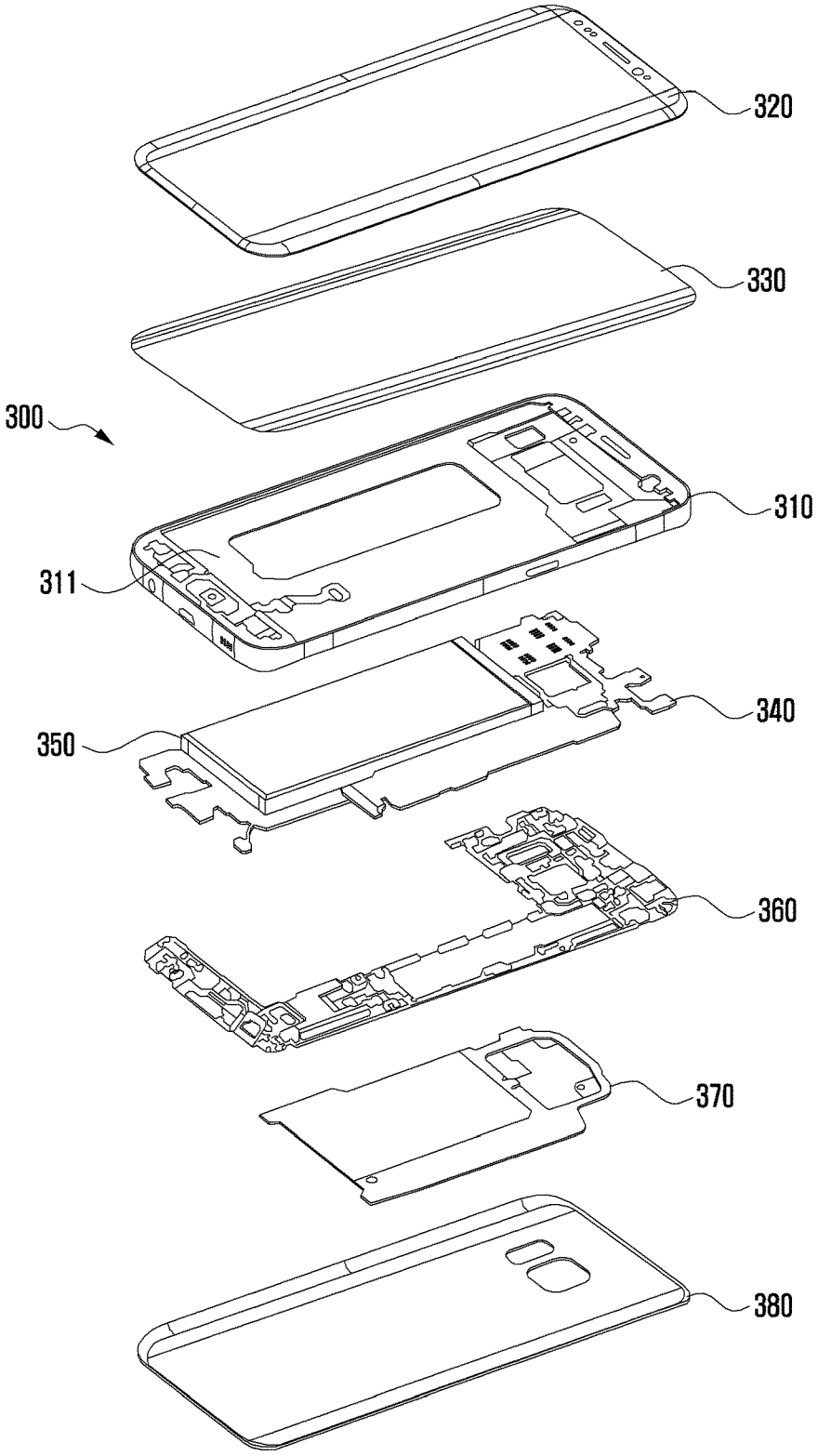
FIG. 3 is an exploded perspective view illustrating the mobile electronic device shown in FIGS. 1 and 2 according to an embodiment of the disclosure.

FIG. 3 is an exploded perspective view illustrating the electronic device of FIG. 1 according to an embodiment of the disclosure.

Referring to FIG. 3, an electronic device 300 may include a side bezel structure 310, a first support member 311 (for example, a bracket), a front plate 320, a display 330, a printed circuit board 340, a battery 350, a second support member 360 (for example, a rear case), an antenna 370, and a rear plate 380. In some embodiments, at least one of the elements (for example, the first support member 311 or the second support member 360) of the electronic device 300 may be omitted, or the electronic device 300 may further include another element. At least one of the elements of the electronic device 300 may be identical or similar to at least one of the elements of the electronic device 100 of FIG. 1 or FIG. 2, and repeated descriptions thereof will be omitted herein.

The first support member 311 may be arranged inside the electronic device 300 and connected to the side bezel structure 310, or may be formed integrally with the side bezel structure 310. The first support member 311 may be made of a metal material and/or a nonmetal (for example, polymer) material, for example. The display 330 may be coupled to one surface of the first support member 311, and the printed circuit board 340 may be coupled to the other surface thereof. A processor, a memory, and/or an interface may be mounted on the printed circuit board 340. The processor may include, for example, one or more of a central processing device, an application processor, a graphic processing device, an image signal processor, a sensor hub processor, or a communication processor.

The memory may include a volatile memory or a non-volatile memory, for example.

The interface may include, for example, a high definition multimedia interface (HDMI), a universal serial bus (USB) interface, a secure digital (SD) card interface, and/or an audio interface. The interface may connect the electronic device 300 with an external electronic device electrically or physically, for example, and may include a USB connector, an SD card/multi-media card (MMC) connector, or an audio connector.

The battery 350 is a device for supplying power to at least one element of the electronic device 300, and may include a non-rechargeable primary cell, a rechargeable secondary cell, or a fuel cell, for example. At least a part of the battery 350 may be arranged on substantially the same plane with the printed circuit board 340, for example. The battery 350 may be arranged integrally inside the electronic device 300, or may be arranged such that the same can be attached to/detached from the electronic device 300.

The antenna 370 may be arranged between the rear plate 380 and the battery 350. The antenna 370 may include, for example, a near field communication (NFC) antenna, a wireless charging antenna, and/or a magnetic secure transmission (MST) antenna. The antenna 370 may conduct near-field communication with an external device or may wirelessly transmit/receive power necessary for charging, for example. In another embodiment, an antenna structure may be formed by a part or a combination of the side bezel structure 310 and/or the first support member 311.

The electronic devices may include at least one of various medical devices (e.g., various portable medical measurement devices (such as blood glucose meters, heart rate monitors, blood pressure monitors, or thermometers, and the like), a magnetic resonance angiography (MRA) device, a magnetic resonance imaging (MRI) device, a computed tomography (CT) device, scanners, or ultrasonic devices, and the like), navigation devices, global positioning system (GPS) receivers, event data recorders (EDRs), flight data recorders (FDRs), vehicle infotainment devices, electronic equipment for vessels (e.g., navigation systems, gyrocompasses, and the like), avionics, security devices, head units for vehicles, industrial or home robots, automatic teller machines (ATMs), points of sales (POS s) devices, or Internet of Things (IoT) devices (e.g., light bulbs, various sensors, electric or gas meters, sprinkler devices, fire alarms, thermostats, street lamps, toasters, exercise equipment, hot water tanks, heaters, boilers, and the like).

The electronic devices may further include at least one of parts of furniture or buildings/structures, electronic boards, electronic signature receiving devices, projectors, or various measuring instruments (such as water meters, electricity meters, gas meters, or wave meters, and the like). The electronic devices may be one or more combinations of the above-mentioned devices. The electronic devices may be flexible electronic devices. Also, the electronic devices are not limited to the above-mentioned devices, and may include new electronic devices according to the development of new technologies.

Embodiments of the disclosure will be described in greater detail below with reference to the accompanying drawings. However, the embodiments of the disclosure are not limited to the specific embodiments and should be understood as including all modifications, changes, equivalent devices and methods, and/or alternative embodiments of the disclosure.

The terms "A or B," "at least one of A or/and B," or "one or more of A or/and B" as used herein include all possible combinations of items enumerated with them. For example, "A or B," "at least one of A and B," or "at least one of A or B" may refer, for example, to (1) including at least one A, (2) including at least one B, or (3) including both at least one A and at least one B.

The terms such as "first" and "second" as used herein may modify various elements regardless of an order and/or importance of the corresponding elements, and do not limit the corresponding elements. These terms may be used for the purpose of distinguishing one element from another element. For example, a first user device and a second user device may indicate different user devices regardless of the order or importance. For example, a first element may be referred to as a second element without departing from the scope the disclosure, and similarly, a second element may be referred to as a first element.

It will be understood that, when an element (for example, a first element) is "(operatively or communicatively) coupled with/to" or "connected to" another element (for example, a second element), the element may be directly coupled with/to another element, and there may be an intervening element (for example, a third element) between the element and another element. It will also be understood that, when an element (for example, a first element) is "directly coupled with/to" or "directly connected to" another element (for example, a second element), there is no intervening element (for example, a third element) between the element and another element.

The term "module" as used herein may be defined as, for example, a unit including one of hardware, software, and firmware or any combinations thereof. The term "module" may be interchangeably used with, for example, the terms "unit", "logic", "logical block", "component", or "circuit", and the like. The "module" may be a minimum unit of an integrated component or a part thereof. The "module" may be a minimum unit performing one or more functions or a part thereof.

Figure 4:
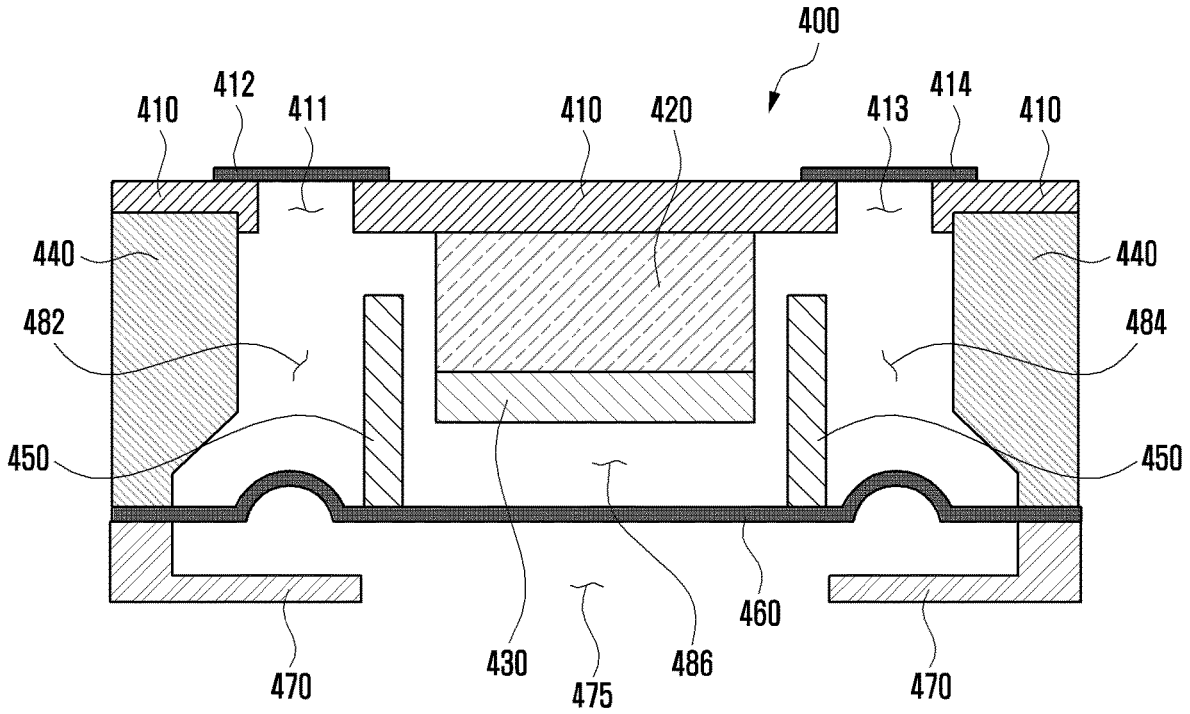
FIG. 4 is a cross-sectional view illustrating an example configuration of an example speaker module according to an embodiment of the disclosure.

FIG. 4 is a cross-sectional view illustrating an example configuration of a speaker module according to an embodiment of the disclosure.

Referring to FIG. 4, the speaker module 400 according to an embodiment may include a yoke 410, a magnet 420, a plate 430, a frame 440, a voice coil 450, a diaphragm 460, and a protection member 470.

According to an embodiment, the yoke 410 may form or define a first surface (e.g., an upper surface) of the speaker module 400. The yoke 410 may fix the magnet 420. The yoke 410 may include a material (e.g., stainless steel such as SUS430 or SUS304, steel plate cold commercial (SPCC), etc.) through which a magnetic force passes. The yoke 410 may include a first hole 411 and a second hole 413. A first ventilation mesh 412 may be disposed over the first hole 411, and a second ventilation mesh 414 may be disposed over the second hole 413. The first ventilation mesh 412 and the second ventilation mesh 414 may be configured to allow air to flow between the inside and outside of the speaker module 400.

According to an embodiment, the magnet 420 may be attached to the yoke 410 through a first surface (e.g., an upper surface) thereof, thus forming a magnetic field. The magnet 420 may include, for example, a neodymium magnet, an alnico magnet, or the like. The magnet 420 may cause the voice coil 450 to vibrate up and down according to Fleming's left-hand rule.

According to an embodiment, the plate 430 may be attached to a second surface (e.g., a lower surface) of the magnet 420 opposite the first surface (e.g., the upper surface). The plate 430 may, for example, perform a function of gathering a magnetic field generated by the magnet 420. The plate 430 may include a material (e.g., SUS430, SUS304, SPCC, etc.) through which a magnetic force passes. Together with the yoke 410 and the magnet 420, the plate 430 may define a magnetic circuit of the speaker module 400. For example, a magnetic flux generated by the magnet 420 may form a magnetic flux path entering the yoke 410 through the plate 430.

According to an embodiment, the frame 440 may be combined with the yoke 410 at a first end (e.g., an upper end) thereof. The frame 440 may form a lateral surface of the speaker module 400. The frame 440 may form an external shape of the speaker module 400. The frame 440 may include plastic, for example.

According to an embodiment, the voice coil 450 may be disposed to be spaced apart from both the magnet 420 and the plate 430. The voice coil 450 may be configured to surround at least a portion of the magnet 420 and the plate 430 without contact. The voice coil 450 may be disposed on an inner surface of the diaphragm 460. The voice coil 450 may be formed of wires wound on at least one axis disposed on the inner surface of the diaphragm 460. The voice coil 450 may vibrate together with the magnet 420 by an electric signal applied from outside, thus enabling the diaphragm 460 to vibrate.

According to an embodiment, the diaphragm 460 may be combined with the voice coil 450. For example, the diaphragm 460 may be disposed such that the voice coil 450 is mounted on the inner surface thereof. The diaphragm 460 may be disposed at a second end (e.g., a lower end) of the frame 440 opposite to the first end (e.g., the upper end). The diaphragm 460 may be configured to output a sound toward a speaker hole (e.g., the speaker hole 107 or 114 in FIG. 1) of an electronic device (e.g., the electronic device 100 in FIG. 1). The diaphragm 460 may generate a sound by vibrating together with the voice coil 450. The diaphragm 460 may, for example, be formed of a thin film.

According to an embodiment, the protection member 470 may form a second surface (e.g., a lower surface) of the speaker module 400 in a direction opposite to the yoke 410 forming the first surface (e.g., the upper surface) of the speaker module 400. The protection member 470 may be disposed on an outer surface of the diaphragm 460. The protection member 470 may be open at least in part to have an acoustic hole 475. The acoustic hole 475 may be disposed toward the speaker hole (e.g., the speaker hole 107 or 114 in FIG. 1) of the electronic device (e.g., the electronic device 100 in FIG. 1).

According to an embodiment, a first space 482 may be formed between the first ventilation mesh 412 and the diaphragm 460. The first space 482 may contain the first hole 411 underlying the first ventilation mesh 412. A second space 484 may be formed between the second ventilation mesh 414 and the diaphragm 460. The second space 484 may contain the second hole 413 underlying the second ventilation mesh 414. A third space 486 may be formed between the plate 430 and the diaphragm 460. The first space 482, the second space 484, and the third space 486 may communicate with each other to allow air to flow.

Figure 5:
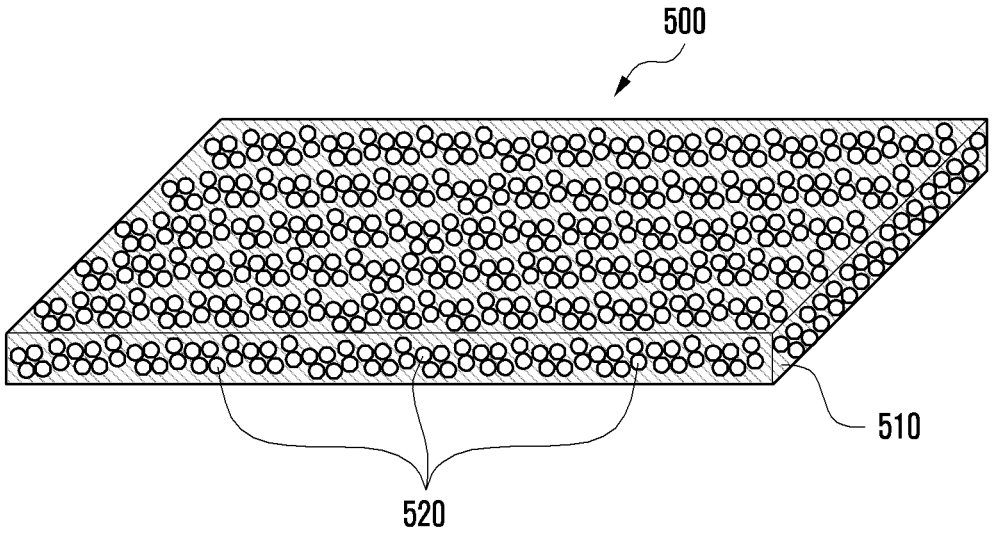
FIG. 5 is a diagram illustrating an example air adsorption member included in a speaker module according to an embodiment of the disclosure.
Figure 6:
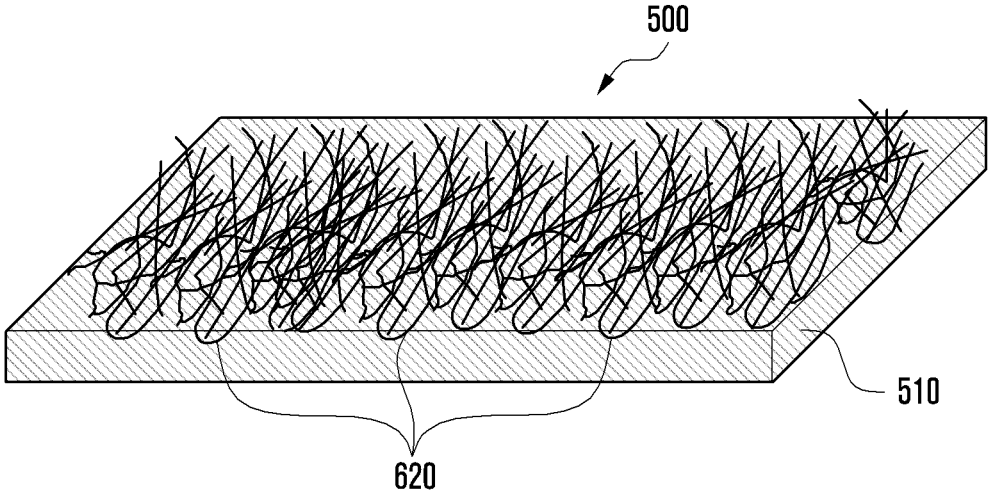
FIG. 6 is a diagram illustrating an example air adsorption member included in a speaker module according to an embodiment of the disclosure.

According to various embodiments, at least one of the yoke 410, the magnet 420, the plate 430, and the frame 440 may include an air adsorption member (e.g., the air adsorption member 500 in FIG. 5 or 6). The air adsorption member may be combined with at least one of the yoke 410, the magnet 420, the plate 430, and the frame 440. The air adsorption member may adsorb air existing in the first space 482, the second space 484, and the third space 486, thereby minimizing and/or reducing air resistance to the vibration of the diaphragm 460. The air adsorption member 500 may be configured to have at least one surface exposed to or in contact with air.

FIG. 5 is a diagram illustrating an example air adsorption member included in a speaker module according to an embodiment of the disclosure. FIG. 6 is a diagram illustrating an example air adsorption member included in a speaker module according to another embodiment of the disclosure.

Referring to FIG. 5, the air adsorption member 500 may be formed by applying an air adsorption material 520 to a sheet 510. The sheet 510 may be formed of a porous material. Absorbing the air adsorption material 520, the sheet 510 may be solidified. The sheet 510 may have a solid material including lumps connected by a binder.

Referring to FIG. 6, the air adsorption member 500 may be formed by embedding nanofibers 620 including an air adsorption material in the sheet 510.

According to an embodiment, when air existing in the first to third spaces 482, 484, and 486 is compressed by the vibration of the diaphragm 460 disposed in the speaker module 400 shown in FIG. 4, the air adsorption material 520 of the air adsorption member 500 may positively adsorb air and thereby minimize and/or reduce air resistance to the diaphragm 460.

According to an embodiment, when air existing in the first to third spaces 482, 484, and 486 is relaxed or expanded by the vibration of the diaphragm 460 disposed in the speaker module 400, the air adsorption material 520 of the air adsorption member 500 may negatively adsorb air and thereby minimize and/or reduce air resistance to the diaphragm 460.

Figure 7:
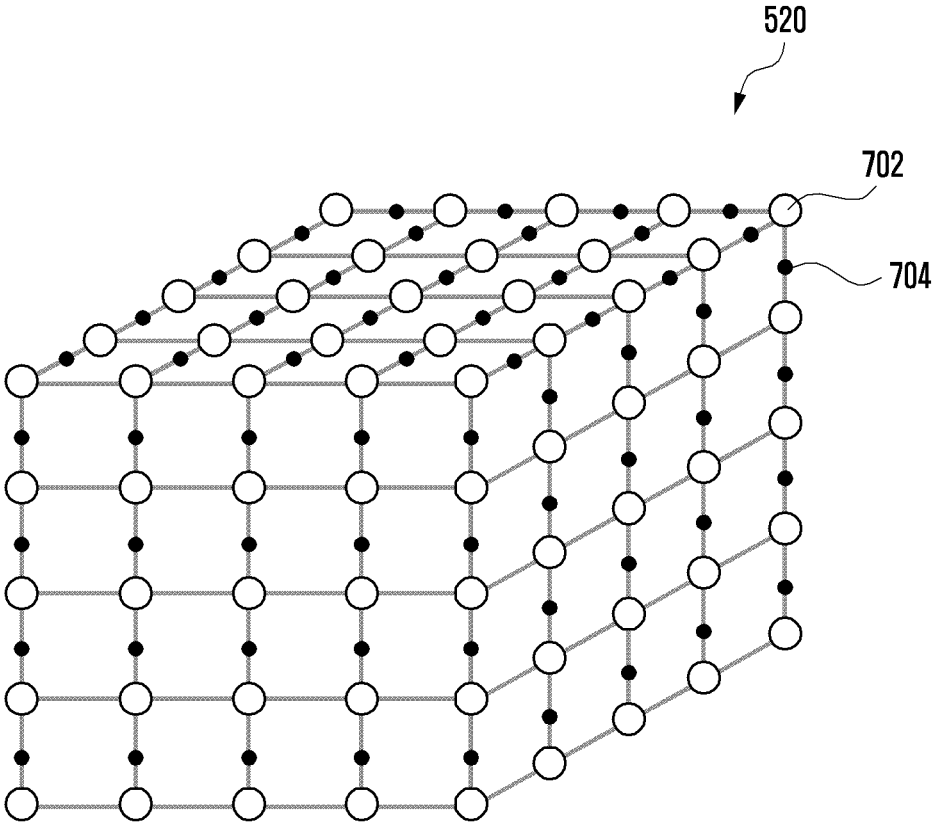
FIG. 7 is a diagram illustrating a molecular structure of an example air adsorption material included in a speaker module according to various embodiments of the disclosure.

FIG. 7 is a diagram illustrating a molecular structure of an example air adsorption material according to various embodiments of the disclosure.

Referring to FIG. 7, the air adsorption material 520 according to various embodiments may include a mixture having a molecular structure of particles 702 and binders 704 to perform positive and negative adsorptions of air.

According to an embodiment, the air adsorption material 520 may be formed, for example, by mixing binders with at least one of granular activated carbon, powdered activated carbon, or acid red 27-crosslinked polyaniline (ARCP).

According to an embodiment, the air adsorption material 520 may be formed, for example, by mixing binders with Cu, Pol, Zr1, Zr2, or Al particles having a metal organic frameworks structure.

According to an embodiment, the air adsorption material 520 may be formed, for example, by mixing binders with at least one of a diatomaceous earth element, a pearlite or silicon dioxide element, or a zeolite element.

According to an embodiment, the air adsorption material 520 may be formed, for example, to have a specific surface area greater than the surface area of a single solid matter. The air adsorption material 520 may be formed, for example, to have a structure capable of increasing the adsorption efficiency of specific element(s) such as, for example, and without limitation, nitrogen ($N_2$) and/or oxygen ($O_2$) contained in the air.

Figure 8:
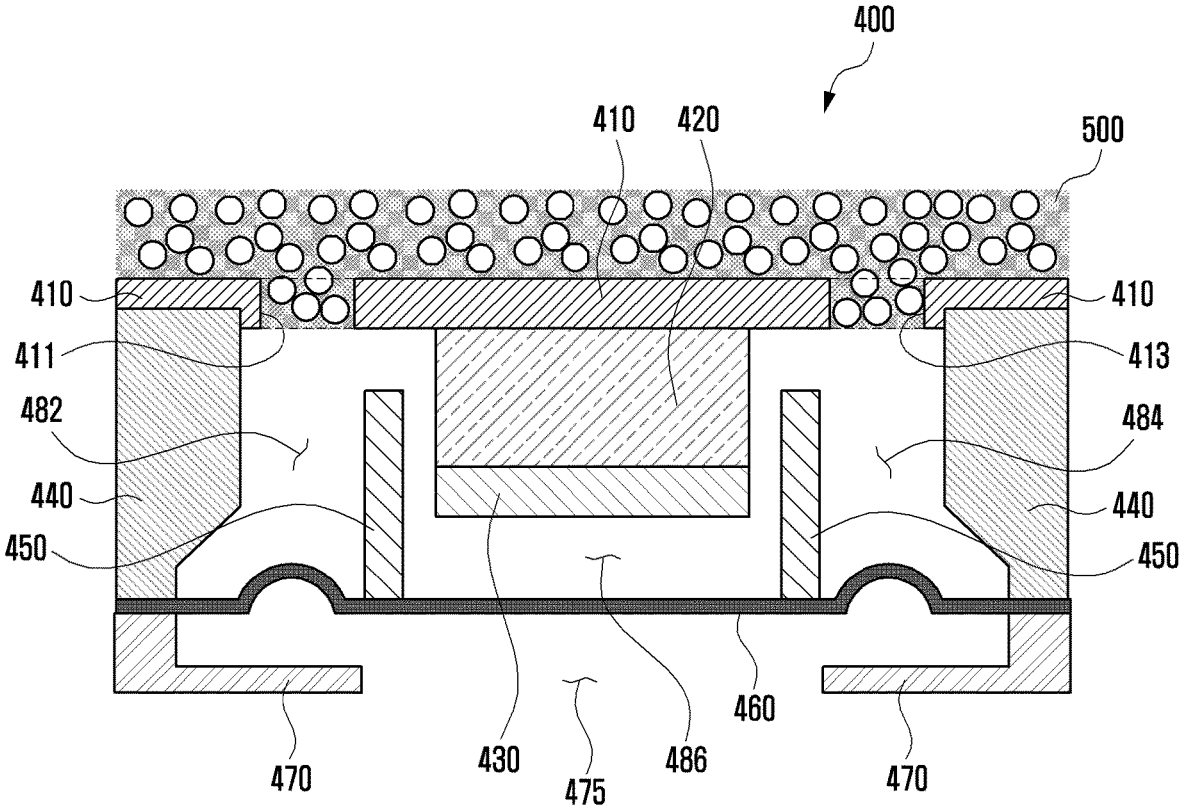
FIG. 8 is a cross-sectional view illustrating an example speaker module including an air adsorption member according to an embodiment of the disclosure.

FIG. 8 is a cross-sectional diagram illustrating an example speaker module including an air adsorption member according to an embodiment of the disclosure.

In describing the embodiment shown in FIG. 8, the description of the same configuration and functions as those of the above-described embodiments shown in FIGS. 4, 5, 6 and 7 may be omitted.

Referring to FIG. 8, in the speaker module 400 according to an embodiment, the first ventilation mesh 412 and the second ventilation mesh 414 shown in FIG. 4 may be omitted.

According to an embodiment, the air adsorption member 500 may be combined with the upper surface of the yoke 410. The air adsorption member 500 may be extended into the first and second holes 411 and 413. The air adsorption member 500 may allow internal and external air of the speaker module 400 to pass through.

According to various embodiments, the yoke 410 may be formed of, at least in part, the air adsorption member 500 or combined with the air adsorption member 500. Similarly, the magnet 420 may be formed of, at least in part, the air adsorption member 500 or combined with the air adsorption member 500. Similarly, the plate 430 may be formed of, at least in part, the air adsorption member 500 or combined with the air adsorption member 500. In this case, the air adsorption member 500 may have properties of a magnetic material. In addition, the frame 440 may be formed of, at least in part, the air adsorption member 500 or combined with the air adsorption member 500.

Figure 9:
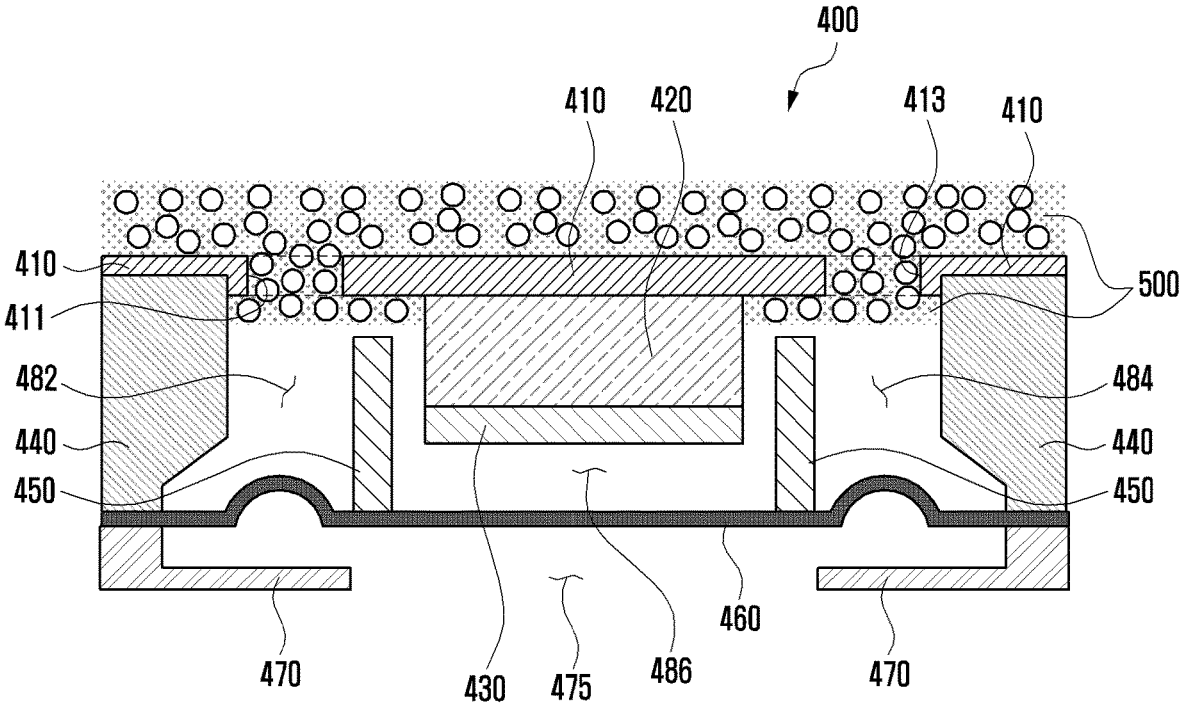
FIG. 9 is a cross-sectional view illustrating an example speaker module including an air adsorption member according to an embodiment of the disclosure.

FIG. 9 is a cross-sectional diagram illustrating an example speaker module including an air adsorption member according to an embodiment of the disclosure.

In describing the embodiment shown in FIG. 9, the description of the same configuration and functions as those of the above-described embodiments shown in FIGS. 4, 5, 6, 7 and 8 may be omitted.

Referring to FIG. 9, in the speaker module 400 according to an embodiment, the first ventilation mesh 412 and the second ventilation mesh 414 shown in FIG. 4 may be omitted.

According to an embodiment, the air adsorption member 500 may be combined with the upper surface of the yoke 410. The air adsorption member 500 may be extended into the first and second holes 411 and 413. Further, the air adsorption member 500 may be extended into at least a portion of the first and second spaces 482 and 484 through the first and second holes 411 and 413. The air adsorption member 500 may allow internal and external air of the speaker module 400 to pass through.

Figure 10:
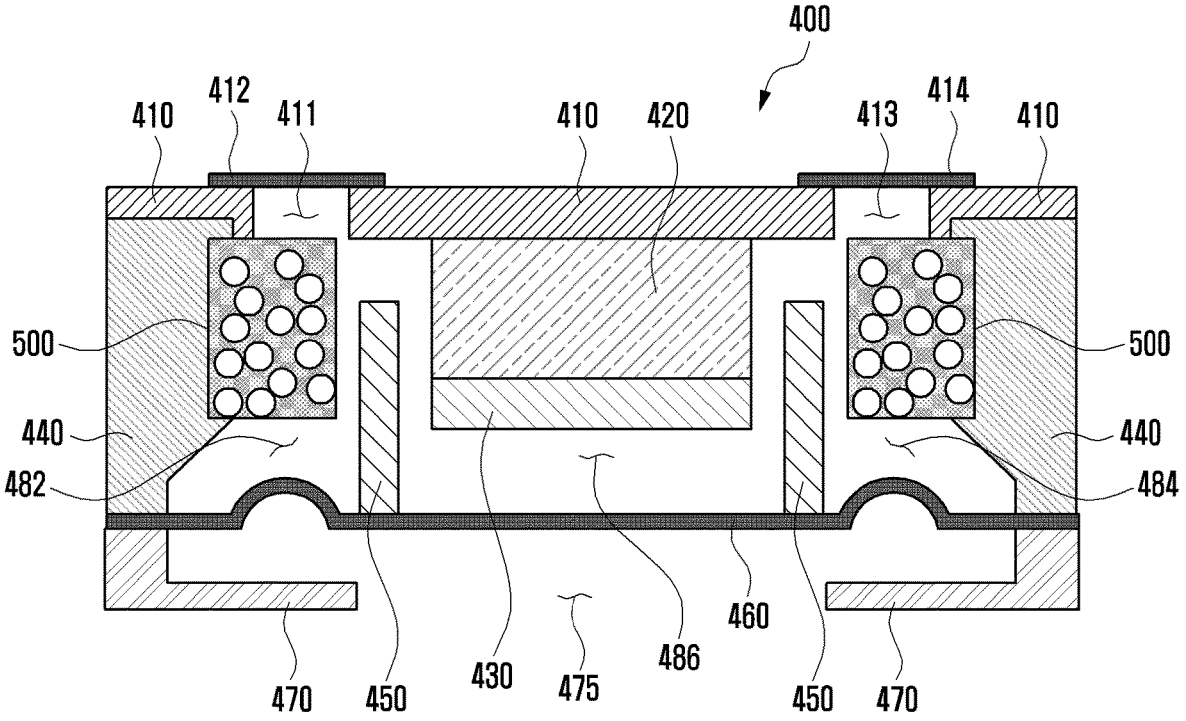
FIG. 10 is a cross-sectional view illustrating an example speaker module including an air adsorption member according to an embodiment of the disclosure.

FIG. 10 is a cross-sectional diagram illustrating an example speaker module including an air adsorption member according to an embodiment of the disclosure.

In describing the embodiment shown in FIG. 10, the description of the same configuration and functions as those of the above-described embodiments shown in FIGS. 4, 5, 6, 7, 8 and 9 may be omitted.

Referring to FIG. 10, in the speaker module 400 according to an embodiment, the air adsorption member 500 may be attached to at least a portion of the inner surface of the frame 440. The air adsorption member 500 may be disposed in the first space 482 between the first ventilation mesh 412 and the diaphragm 460 and in the second space 484 between the second ventilation mesh 414 and the diaphragm 460. In this case, the air adsorption member 500 may be configured to surround the voice coil 450 without contact when a current flows through the speaker module 400.

According to various embodiments, at least a portion of the first ventilation mesh 412 may be replaced with the air adsorption member 500. Similarly, at least a portion of the second ventilation mesh 414 may be replaced with the air adsorption member 500. In addition, at least a portion of the air adsorption member 500 may be attached to the outer surface of the plate 430. In this case, at least a portion of the air adsorption member 500 may be disposed between the plate 430 and the diaphragm 460. Also, at least a portion of the air adsorption member 500 may be disposed in the third space 486.

Figure 11:
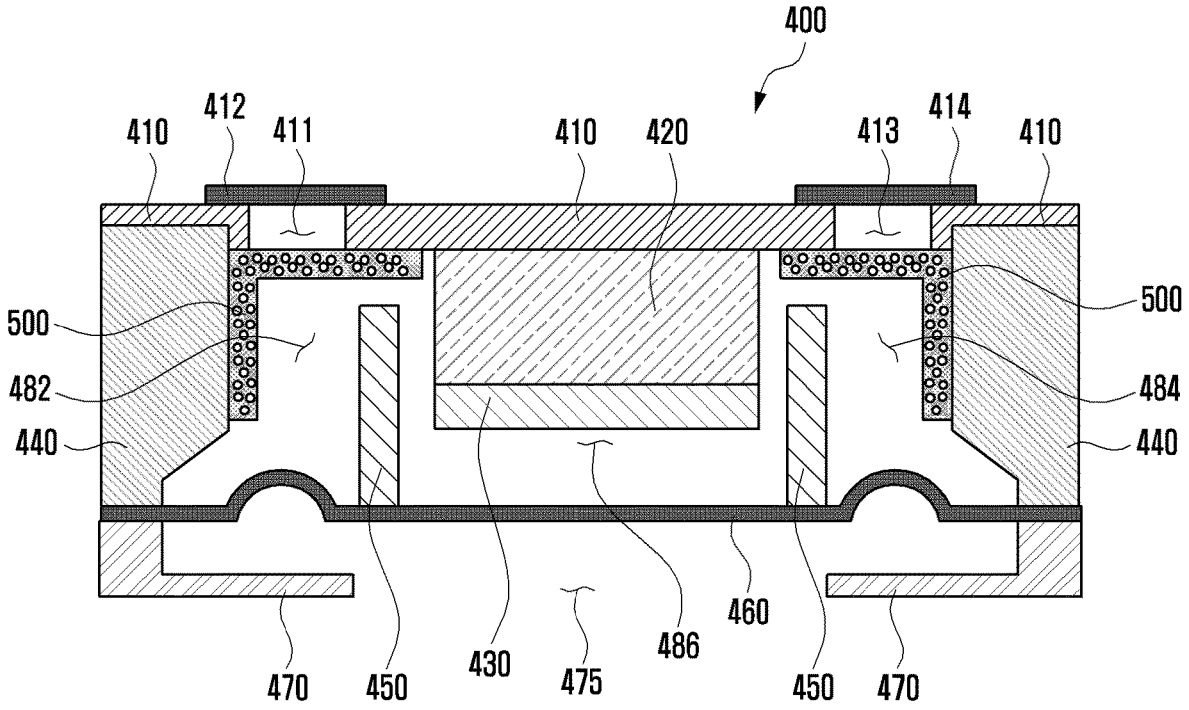
FIG. 11 is a cross-sectional view schematically showing a speaker module including an air adsorption member according to yet another embodiment of the disclosure.

FIG. 11 is a cross-sectional diagram illustrating an example speaker module including an air adsorption member according to yet another embodiment of the disclosure.

In describing the embodiment shown in FIG. 11, the description of the same configuration and functions as those of the above-described embodiments shown in FIGS. 4, 5, 6, 7, 8, 9 and 10 may be omitted.

Referring to FIG. 11, in the speaker module 400 according to an embodiment, the air adsorption member 500 may be attached to the inner surface of the frame 440 and the yoke 410.

According to various embodiments, the air adsorption member 500 may be disposed in the first space 482 between the first ventilation mesh 412 and the diaphragm 460 and in the second space 484 between the second ventilation mesh 414 and the diaphragm 460. In this case, the air adsorption member 500 may be configured to surround the voice coil 450 without contact when a current flows through the speaker module 400.

Figure 12:
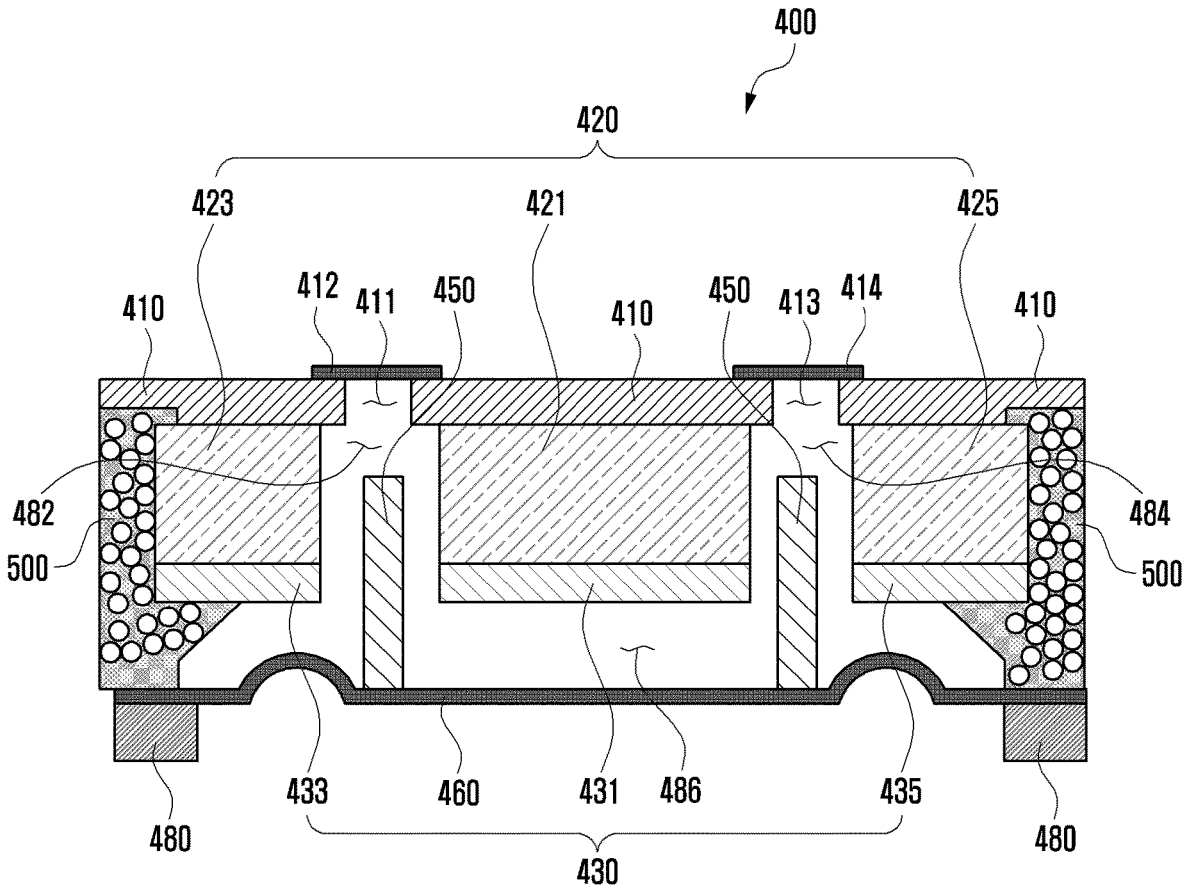
FIG. 12 is a cross-sectional view illustrating an example speaker module including an air adsorption member according to an embodiment of the disclosure.

FIG. 12 is a cross-sectional diagram illustrating an example speaker module including an air adsorption member according to an embodiment of the disclosure.

In describing the embodiment shown in FIG. 12, the description of the same configuration and functions as those of the above-described embodiments shown in FIGS. 4, 5, 6, 7, 8, 9, 10 and 11 may be omitted.

Referring to FIG. 12, in the speaker module 400 according to an embodiment, the magnet 420 may be divided into a first magnet 421, a second magnet 423, and a third magnet 425.

According to an embodiment, the first magnet 421 and the second magnet 423 may be spaced apart from each other by the first space 482. The first magnet 421 and the third magnet 425 may be spaced apart from each other by the second space 484.

In addition, in the speaker module 400 according to an embodiment, the plate 430 may be divided into a first plate 431, a second plate 433, and a third plate 435.

According to an embodiment, the first plate 431, the second plate 433, and the third plate 435 may be mounted on the outer surfaces of the first magnet 421, the second magnet 423, and the third magnet 425, respectively.

According to an embodiment, the second magnet 423 and the second plate 433 may be disposed on one portion of the frame 440 adjacent to the first space 482. Similarly, the third magnet 425 and the third plate 435 may be disposed on another portion of the frame 440 adjacent to the second space 484.

In the speaker module 400 according to an embodiment, the protection member 470 shown in FIG. 4 may be replaced with a housing 480 (e.g., the housing 110 in FIG. 1). The housing 480 may be disposed on the outer surface of the diaphragm 460. Although FIG. 12 shows that the housing 480 is used instead of the protection member, the protection member 470 shown in FIG. 4 may be used without replaced.

According to various embodiments, at least one of the yoke 410, the magnet 420, the plate 430, and the frame 440 may include the air adsorption member 500. The air adsorption member 500 may be combined with at least one of the yoke 410, the magnet 420, the plate 430, and the frame 440. The air adsorption member 500 may adsorb air existing in the first space 482, the second space 484, and the third space 486, thereby minimizing and/or reduce air resistance to the vibration of the diaphragm 460. The air adsorption member 500 may be configured to have at least one surface being exposed to or in contact with air.

In case of the embodiment shown in FIG. 12, at least a portion of the frame 440 may be formed of the air adsorption member 500.

Figure 13:
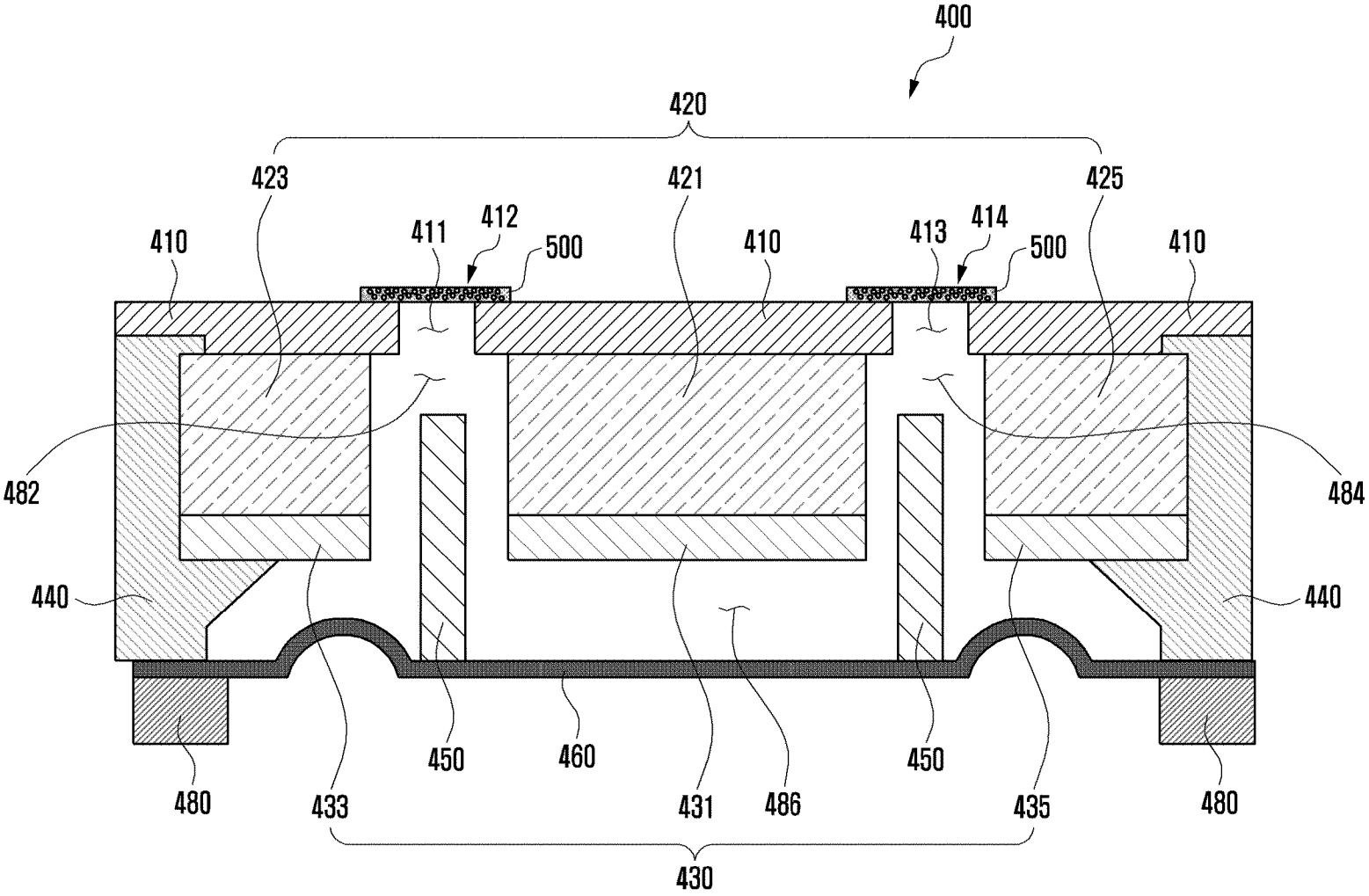
FIG. 13 is a cross-sectional view illustrating an example speaker module including an air adsorption member according to an embodiment of the disclosure.

FIG. 13 is a cross-sectional diagram illustrating an example speaker module including an air adsorption member according to an embodiment of the disclosure.

In describing the embodiment shown in FIG. 13, the description of the same configuration and functions as those of the above-described embodiments shown in FIGS. 4, 5, 6, 7, 8, 9, 10, 11 and 12 may be omitted.

Referring to FIG. 13, in the speaker module 400 according to an embodiment, the first ventilation mesh 412 and the second ventilation mesh 414 may be replaced, at least in part, with the air adsorption member 500.

According to an embodiment, the first ventilation mesh 412 and the second ventilation mesh 414 may include, at least in part, of the air adsorption member 500, which may allow internal and external air of the speaker module 400 to pass through.

Figure 14:
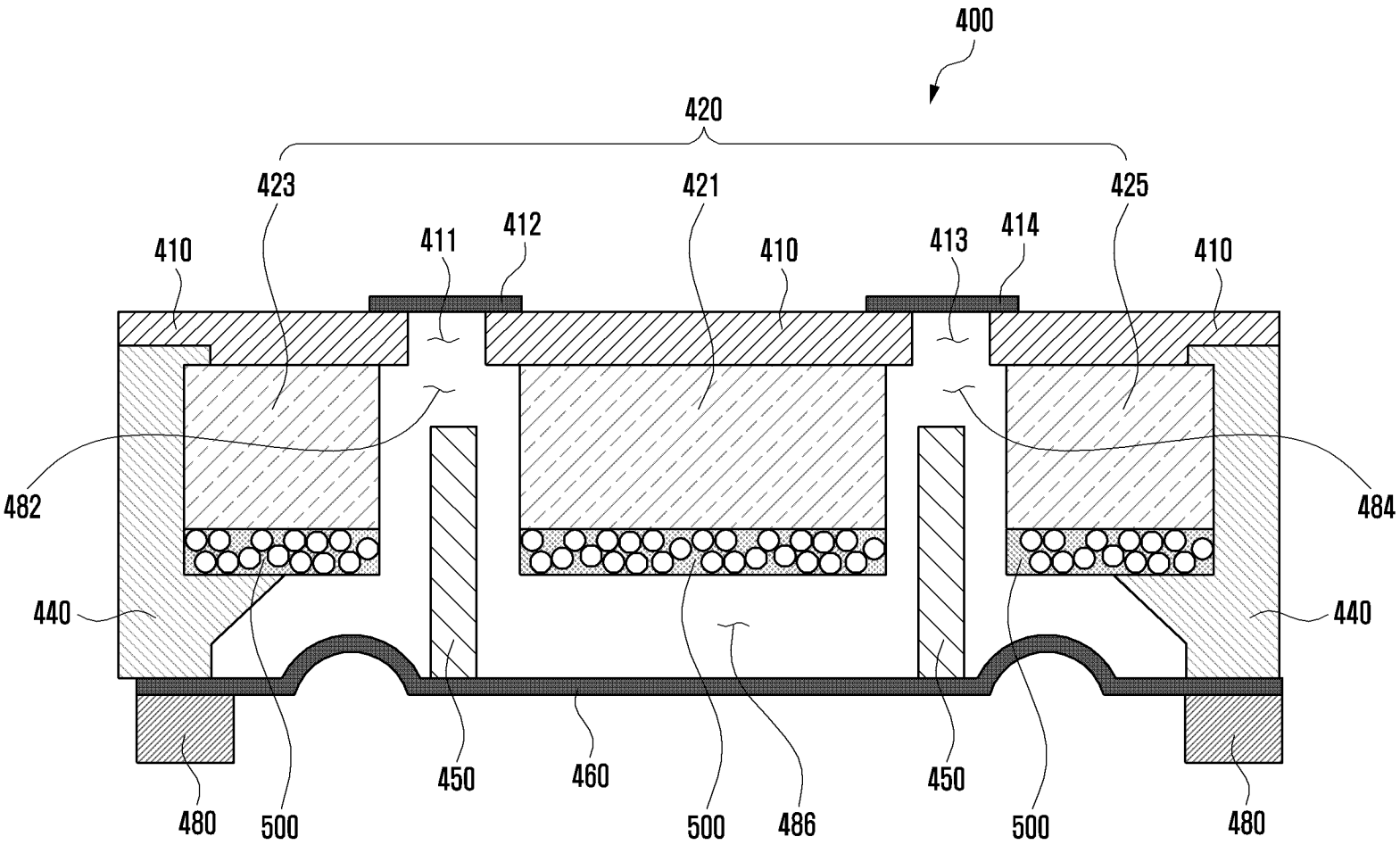
FIG. 14 is a cross-sectional view illustrating an example speaker module including an air adsorption member according to an embodiment of the disclosure.

FIG. 14 is a cross-sectional diagram illustrating an example speaker module including an air adsorption member according to an embodiment of the disclosure.

In describing the embodiment shown in FIG. 14, the description of the same configuration and functions as those of the above-described embodiments shown in FIGS. 4, 5, 6, 7, 8, 9, 10, 11, 12 and 13 may be omitted.

Referring to FIG. 14, in the speaker module 400 according to an embodiment, the plate 430 may be replaced with the air adsorption member 500. In this case, the air adsorption member 500 may have properties of a magnetic material.

Figure 15:
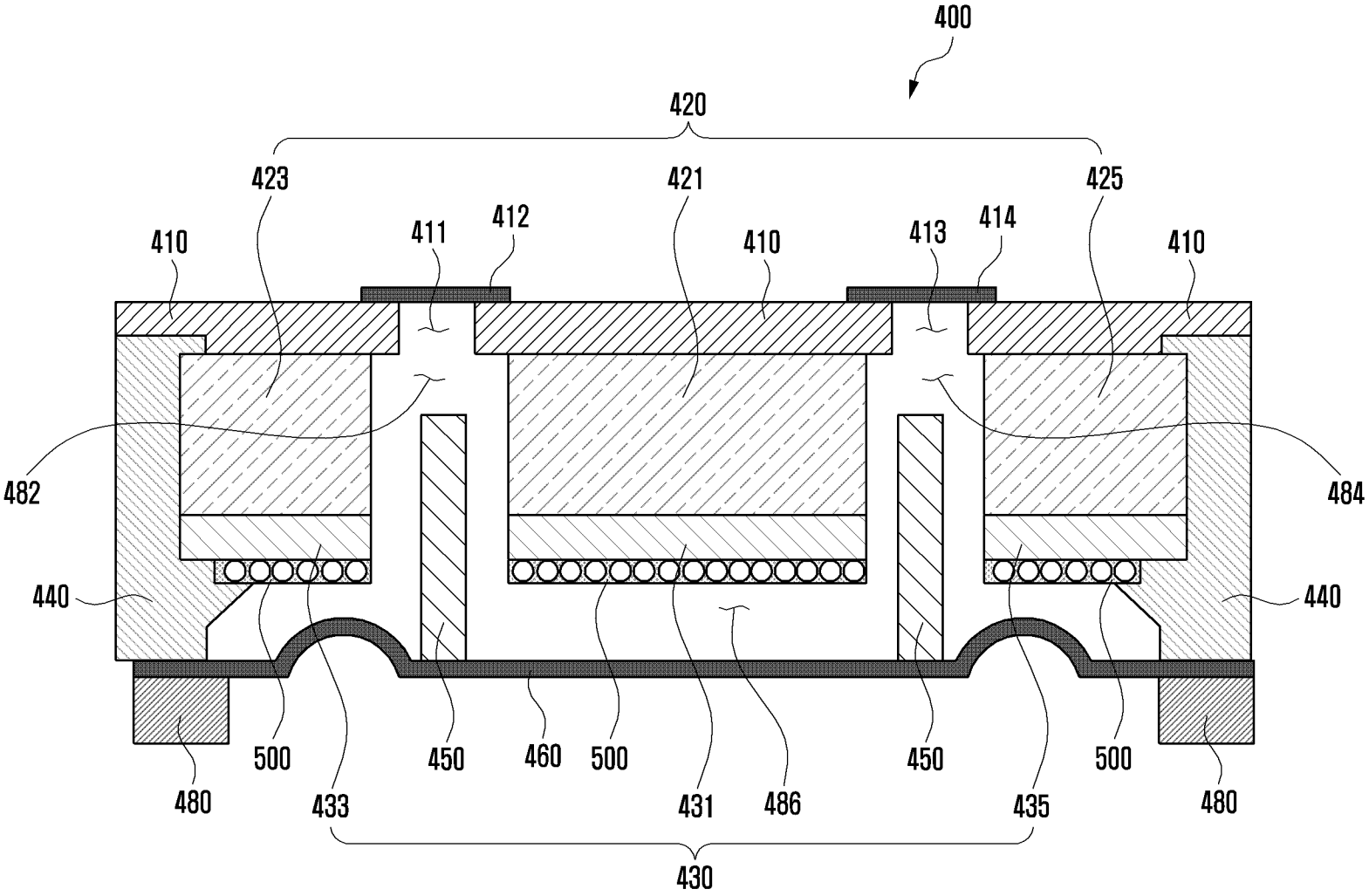
FIG. 15 is a cross-sectional view illustrating an example speaker module including an air adsorption member according to an embodiment of the disclosure.

FIG. 15 is a cross-sectional diagram illustrating an example speaker module including an air adsorption member according to an embodiment of the disclosure.

In describing the embodiment shown in FIG. 15, the description of the same configuration and functions as those of the above-described embodiments shown in FIGS. 4, 5, 6, 7, 8, 9, 10, 11, 12, 13 and 14 may be omitted.

Referring to FIG. 15, in the speaker module 400 according to an embodiment, the air adsorption member 500 may be combined with at least a portion of the outer surface of the plate 430. In this case, the air adsorption member 500 may be disposed between the plate 430 and the diaphragm 460.

Figure 16:
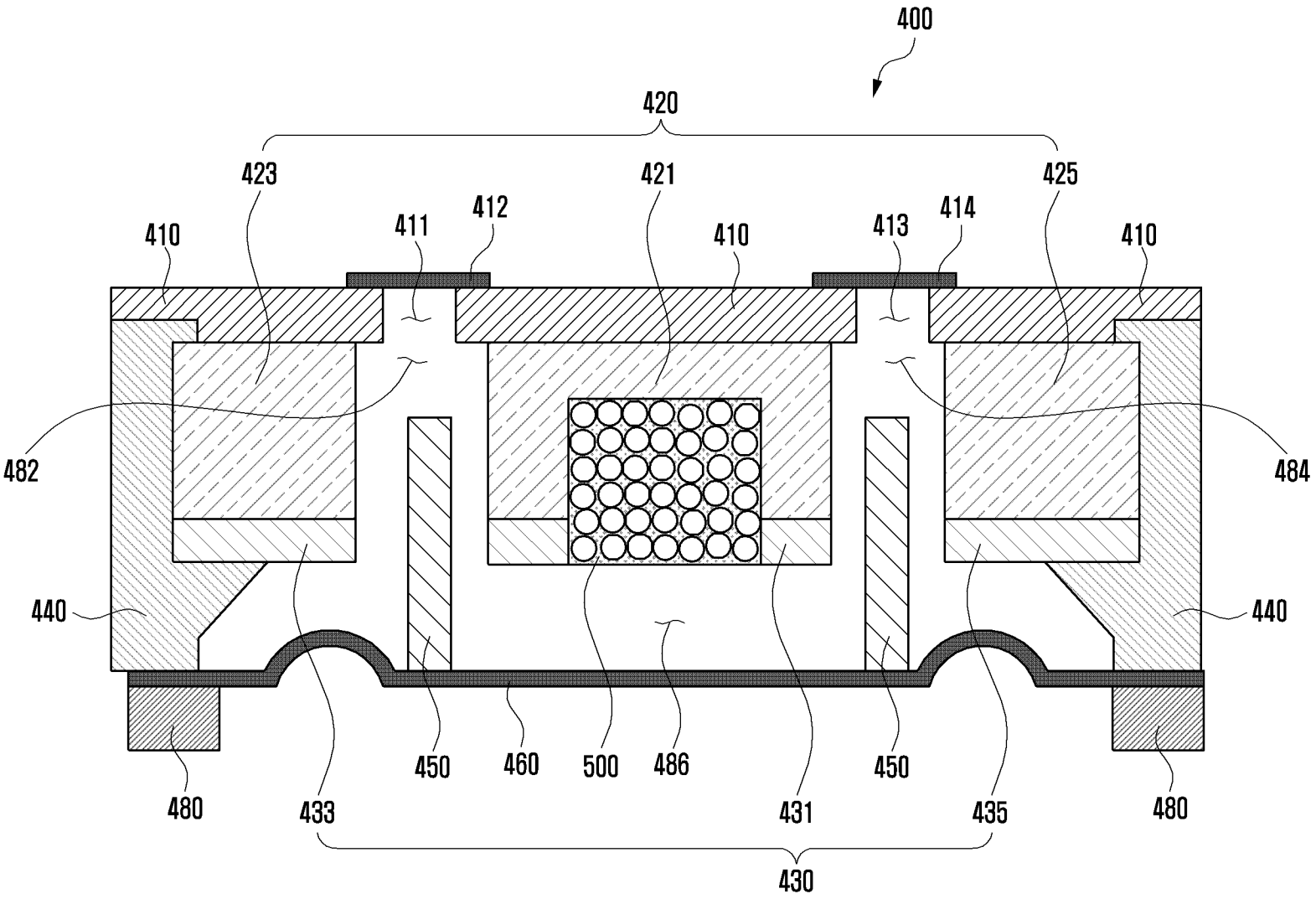
FIG. 16 is a cross-sectional view illustrating an example speaker module including an air adsorption member according to an embodiment of the disclosure.

FIG. 16 is a cross-sectional diagram illustrating an example speaker module including an air adsorption member according to an embodiment of the disclosure.

In describing the embodiment shown in FIG. 16, the description of the same configuration and functions as those of the above-described embodiments shown in FIGS. 4, 5, 6, 7, 8, 9, 10, 11, 12, 13, 14 and 15 may be omitted.

Referring to FIG. 16, in the speaker module 400 according to an embodiment, the air adsorption member 500 may be included, at least in part, in both the magnet 420 and the plate 430.

Figure 17:
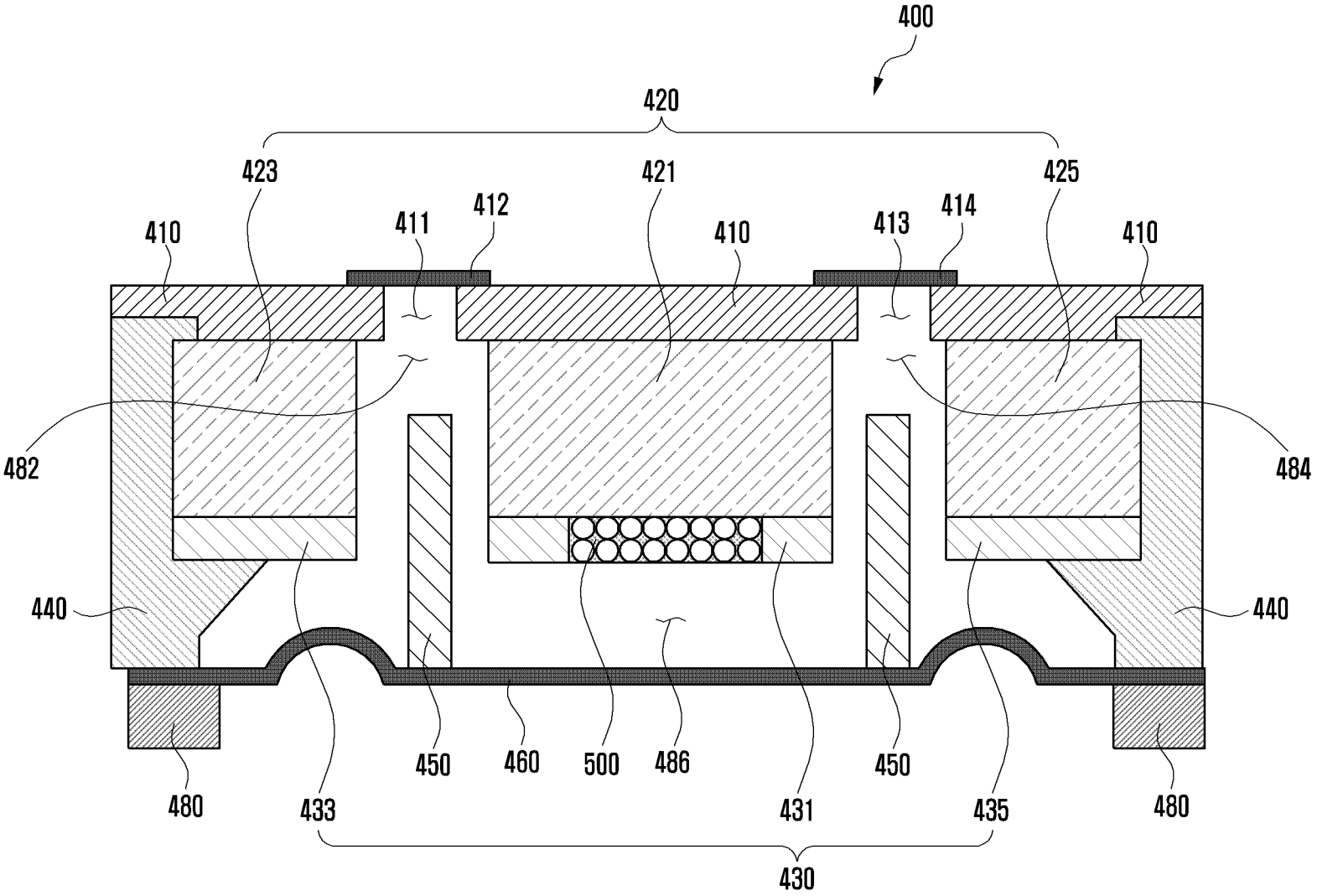
FIG. 17 is a cross-sectional view illustrating an example speaker module including an air adsorption member according to an embodiment of the disclosure.

FIG. 17 is a cross-sectional diagram illustrating an example speaker module including an air adsorption member according to an embodiment of the disclosure.

In describing the embodiment shown in FIG. 17, the description of the same configuration and functions as those of the above-described embodiments shown in FIGS. 4, 5, 6, 7, 8, 9, 10, 11, 12, 13, 14, 15 and 16 may be omitted.

Referring to FIG. 17, in the speaker module 400 according to an embodiment, the plate 430 may include at least in part the air adsorption member 500. Although FIG. 17 shows that the air adsorption member 500 is included in the first plate 431, the air adsorption member 500 may also be included in the second plate 433 and/or the third plate 435.

Figure 18:
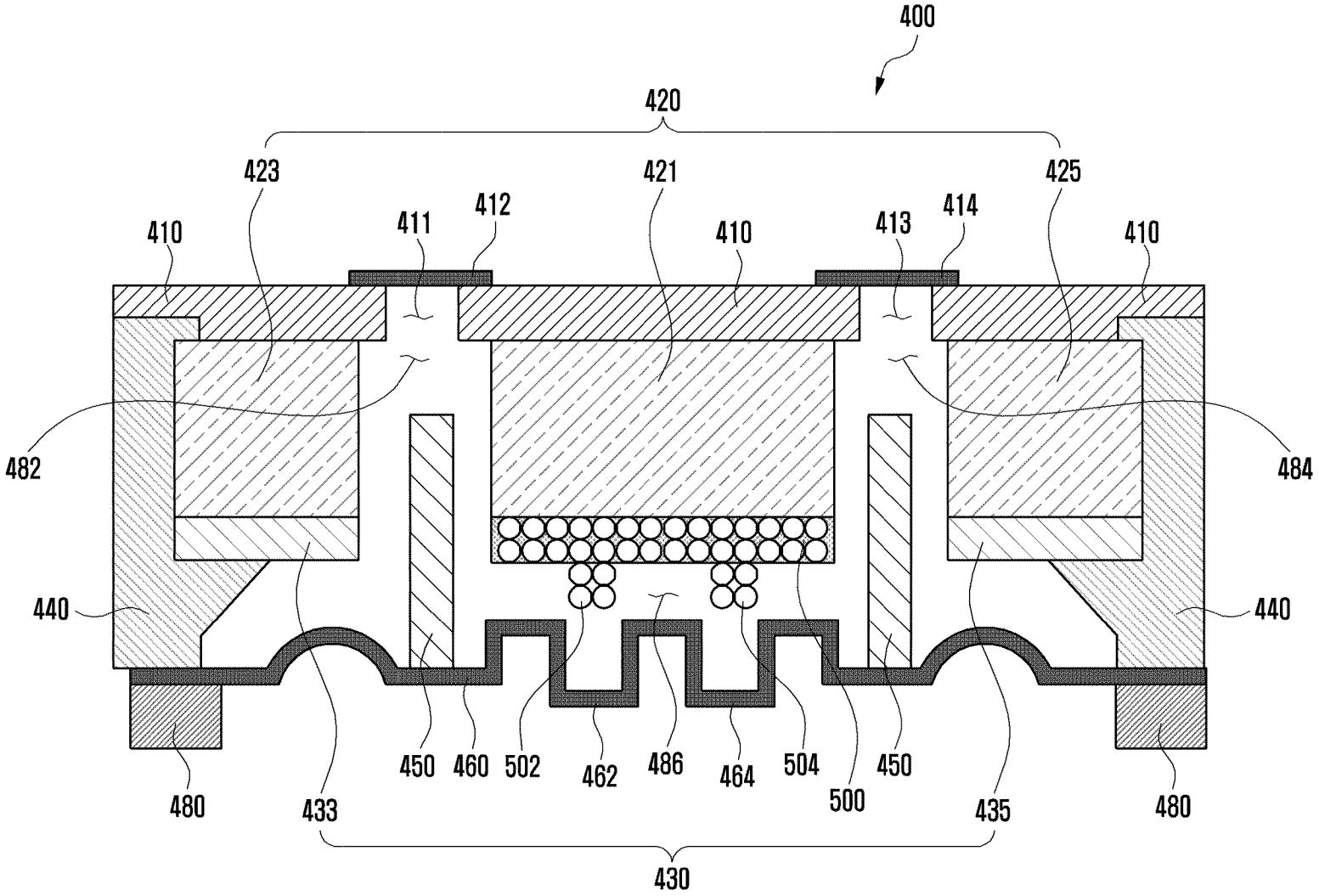
FIG. 18 is a cross-sectional view illustrating an example speaker module including an air adsorption member according to an embodiment of the disclosure.

FIG. 18 is a cross-sectional diagram illustrating an example speaker module including an air adsorption member according to an embodiment of the disclosure.

In describing the embodiment shown in FIG. 18, the description of the same configuration and functions as those of the above-described embodiments shown in FIGS. 4, 5, 6, 7, 8, 9, 10, 11, 12, 13, 14, 15, 16 and 17 may be omitted.

Referring to FIG. 18, in the speaker module 400 according to an embodiment, the diaphragm 460 may have an uneven structure including at least one convex portion. For example, the diaphragm 460 may include a first convex portion 462 and a second convex portion 464.

According to an embodiment, at least a portion of the plate 430 may be replaced with the air adsorption member 500. For example, the first plate 431 may be replaced with the air adsorption member 500. In this case, the air adsorption member 500 may have a first protrusion 502 and a second protrusion 504 at positions corresponding to the first convex portion 462 and the second convex portion 464 of the diaphragm 460.

Figure 19:
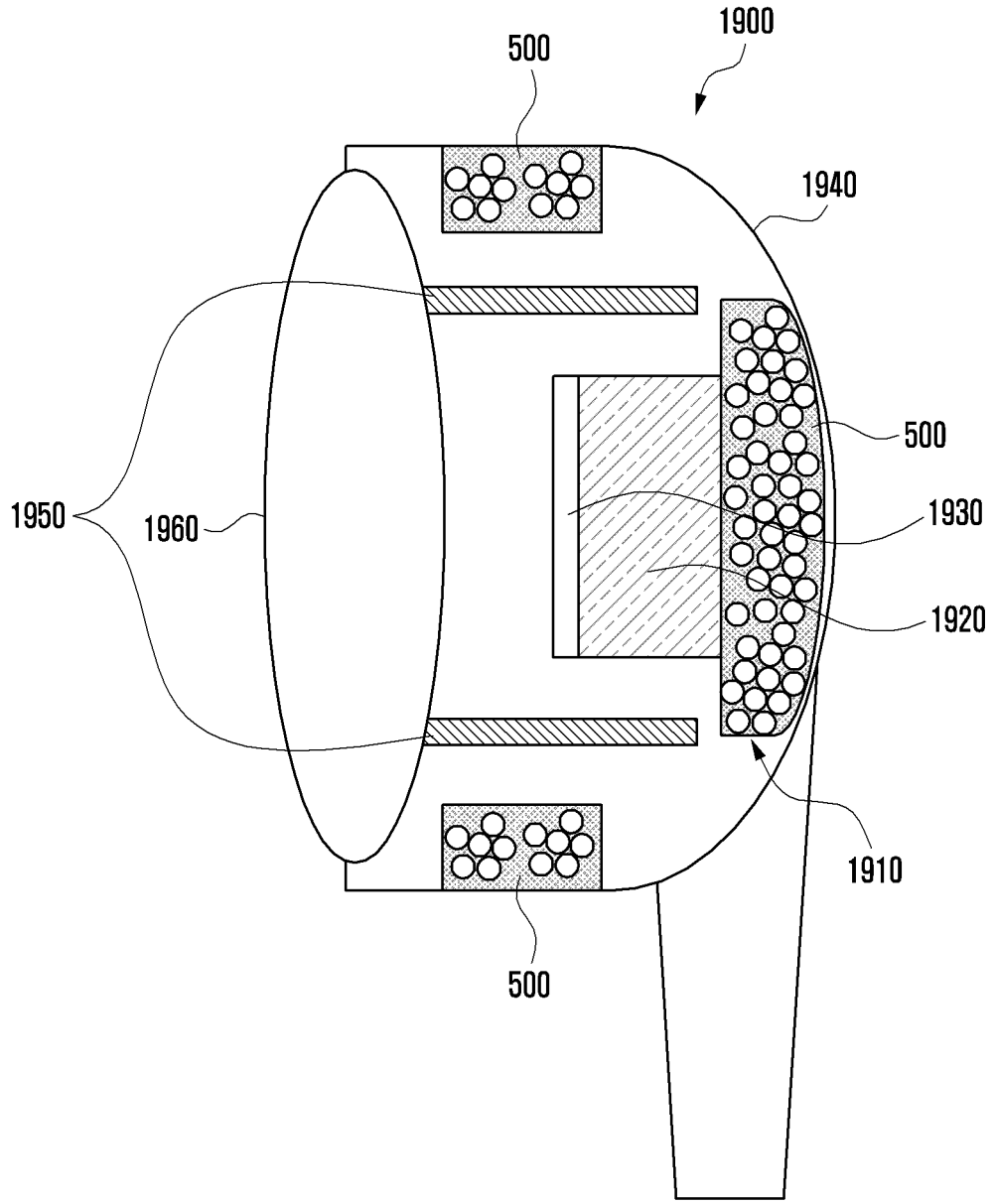
FIG. 19 is a cross-sectional view illustrating an example of applying an air adsorption member to an earphone according to an embodiment of the disclosure.

FIG. 19 is a cross-sectional diagram illustrating an example of applying an air adsorption member to an earphone according to an embodiment of the disclosure.

Referring to FIG. 19, the earphone 1900 according to an embodiment may include a yoke 1910, a magnet 1920, a plate 1930, a housing 1940, a voice coil 1950, and a diaphragm 1960. The earphone 1900 may further include the air adsorption member 500.

According to an embodiment, the air adsorption member 500 may be disposed on the inner surface of the housing 1940. For example, the air adsorption member 500 may be disposed on the inner surface of the housing 1940 corresponding to the outer surface of the voice coil 1950. In addition, at least a portion of the yoke 1910 may be formed of or combined with the air adsorption member 500.

Figure 20:
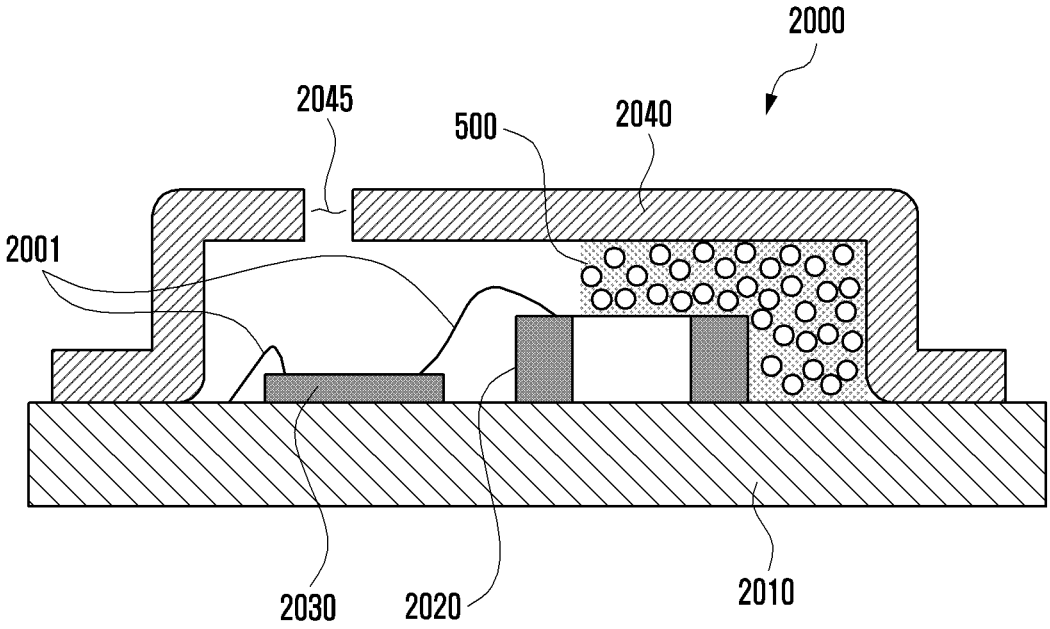
FIG. 20 is a cross-sectional view illustrating an example of applying an air adsorption member to a microphone according to an embodiment of the disclosure.
Figure 21:
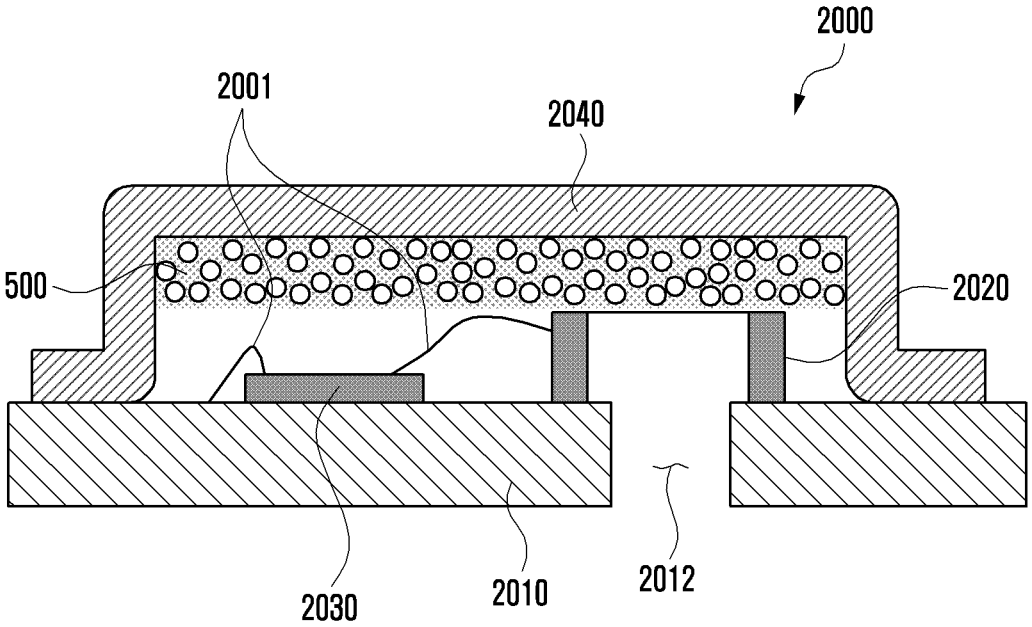
FIG. 21 is a cross-sectional view illustrating an example of applying an air adsorption member to a microphone according to an embodiment of the disclosure.

FIG. 20 is a cross-sectional diagram illustrating an example of applying an air adsorption member to a microphone according to an embodiment of the disclosure. FIG. 21 is a cross-sectional diagram illustrating an example of applying an air adsorption member to a microphone according to an embodiment of the disclosure.

Referring to FIG. 20, the microphone 2000 may include a printed circuit board (PCB) 2010, an audio creator 2020, a signal processor (e.g., including signal processing circuitry) 2030, and a case 2040. In particular, the microphone 2000 may further include the air adsorption member 500.

According to an embodiment, the signal processor 2030 may include various processing circuitry and be connected to both the PCB 2010 and the audio creator 2020 through wires 2001. The case 2040 may include at least one sound hole 2045.

According to an embodiment, the air adsorption member 500 may be disposed between the PCB 2010 and the case 2040. In this case, the air adsorption member 500 may be disposed at a position avoiding the sound hole 2045. For example, the air adsorption member 500 may be disposed, at least in part, to surround at least a portion of the upper surface of the audio creator 2020 between the PCB 2010 and the case 2040.

Referring to FIG. 21, the microphone 2000 may include the PCB 2010, the audio creator 2020, the signal processor 2030, and the case 2040. For example, the microphone 2000 may further include the air adsorption member 500.

According to an embodiment, the signal processor 2030 may be connected to both the PCB 2010 and the audio creator 2020 through the wires 2001. The PCB 2010 may include at least one sound hole 2012.

According to an embodiment, the air adsorption member 500 may be disposed on the inner surface of the case 2040. For example, the air adsorption member 500 may be disposed on the inner surface of the case 2040 located over the audio creator 2020 and the signal processor 2030.

Figure 22:
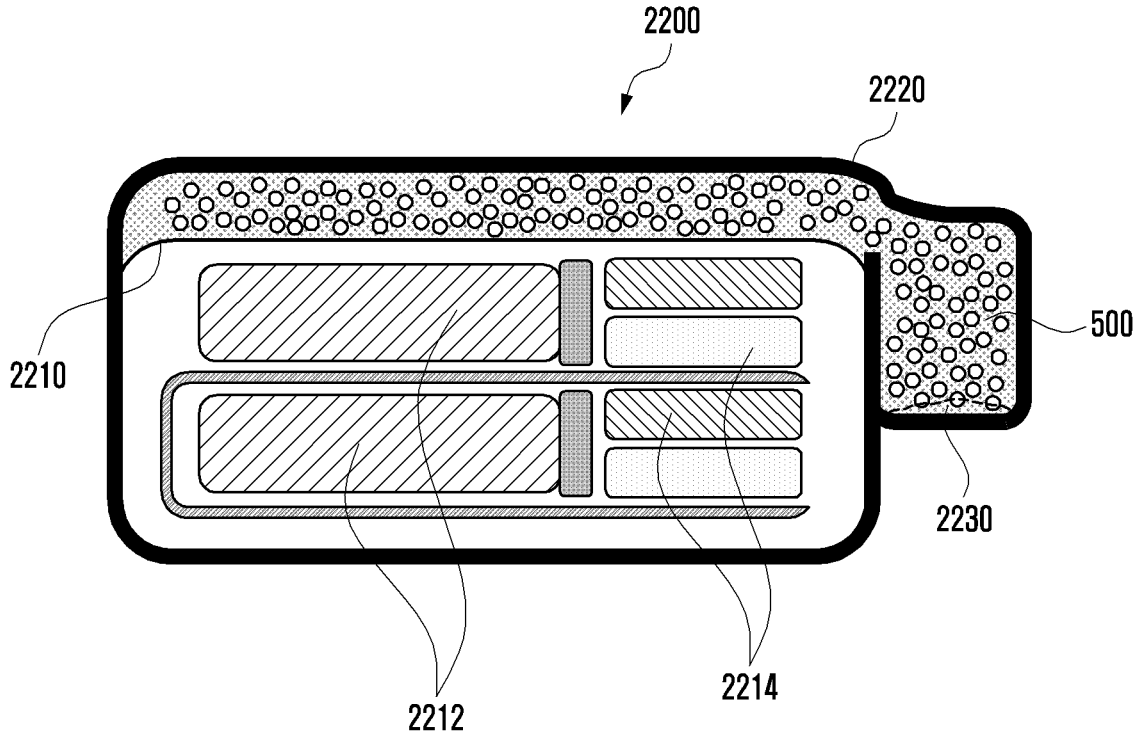
FIG. 22 is a cross-sectional view illustrating an example of applying an air adsorption member to an armature speaker according to an embodiment of the disclosure.

FIG. 22 is a cross-sectional diagram illustrating an example of applying an air adsorption member to an armature speaker according to an embodiment of the disclosure.

Referring to FIG. 22, the armature speaker 2200 may include a membrane 2210, a housing 2220, and the air adsorption member 500. The membrane 2210 may include a pair of coils 2212 and a pair of magnets 2214. The housing 2220 may include a case protecting the membrane 2210. A sound emitting hole 2230 may be formed in a portion of the housing 2220.

According to an embodiment, the air adsorption member 500 may be disposed outside the membrane 2210 and inside the housing 2220.

According to various example embodiments of the disclosure, a speaker module may include a yoke defining one surface of the speaker module; a magnet attached to the yoke through a first surface of the magnet; a plate attached to a second surface of the magnet; a frame providing a lateral surface of the speaker module and combined with the yoke at a first end of the frame; a voice coil disposed to be spaced apart from the magnet; and a diaphragm combined with the voice coil at an inner surface of the diaphragm. In the speaker module, at least one of the yoke, the magnet, the plate, and the frame may include at least a portion of an air adsorption member comprising an air adsorption material configured to adsorb air in the speaker module based on the diaphragm vibrating.

According to various example embodiments, the air adsorption member 500 may be combined with at least a portion of the yoke, the magnet, the plate, and/or the frame.

According to various example embodiments, the air adsorption member, which is included in or is combined with at least a portion of the yoke, the magnet, the plate, and the frame, may be configured to have at least one surface in contact with the air.

According to various example embodiments, the air adsorption member may comprise an air adsorption material applied to a sheet, and the air adsorption material may have a molecular structure including particles and binders configured to perform positive and negative adsorptions of air.

According to various example embodiments, the air adsorption member may be attached to an inner surface of the frame and the yoke without being contact with the voice coil.

According to various example embodiments, at least a portion of the air adsorption member may be combined with an outer surface of the plate.

According to various example embodiments, at least a portion of the air adsorption member may be included in at least a portion of the magnet and at least a portion of the plate.

According to various example embodiments, the diaphragm may include at least one convex portion, at least a portion of the plate may include the air adsorption member, and the air adsorption member may include at least one protrusion at a position corresponding to the at least one convex portion.

According to various example embodiments, the yoke may have a first hole and a second hole.

According to various example embodiments, the air adsorption member may be combined with an upper surface of the yoke, the first hole, and the second hole.

According to various example embodiments, a first ventilation mesh may be disposed over the first hole, and a second ventilation mesh may be disposed over the second hole.

According to various example embodiments, the first ventilation mesh and the second ventilation mesh may include the air adsorption member.

According to various example embodiments, a first space may be provided between the first ventilation mesh and the diaphragm, a second space may be provided between the second ventilation mesh and the diaphragm, and a third space may be provided between the plate and the diaphragm.

According to various example embodiments, the air adsorption member may be combined with at least a portion of the frame disposed in the first space and with at least a portion of the frame disposed in the second space.

According to various example embodiments of the disclosure, an electronic device (e.g., the electronic device 100 in FIG. 1) may include a housing (e.g., the housing 110 in FIG. 1) providing at least a part of a lateral surface of the electronic device; and a speaker module accommodated in the housing. The speaker module may include a yoke defining one surface of the speaker module; a magnet attached to the yoke through a first surface of the magnet; a plate attached to a second surface of the magnet; a frame providing a lateral surface of the speaker module and combined with the yoke at a first end of the frame; a voice coil disposed to be spaced apart from the magnet; and a diaphragm combined with the voice coil at an inner surface of the diaphragm. At least one of the yoke, the magnet, the plate, and the frame may be combined with at least a portion of an air adsorption member comprising an air adsorption material configured to adsorb air in the speaker module based on the diaphragm vibrating.

According to various example embodiments, at least a portion of the yoke, the magnet, the plate, and the frame may include at least a portion of the air adsorption member.

According to various example embodiments, the air adsorption member, which is combined with and/or includes at least a portion of the yoke, the magnet, the plate, and the frame, may have at least one surface in contact with the air.

According to various example embodiments, the air adsorption member may comprise an air adsorption material applied to a sheet, and the air adsorption material may have a molecular structure including particles and binders configured to perform positive and negative adsorptions of air.

According to various example embodiments, the yoke may have a first hole and a second hole. A first ventilation mesh may be disposed over the first hole, and a second ventilation mesh may be disposed over the second hole. The first ventilation mesh and the second ventilation mesh may include the air adsorption member.

According to various example embodiments, at least a portion of the air adsorption member may be included in at least a portion of the magnet and at least a portion of the plate.

While the disclosure has been illustrated and described with reference to various example embodiments thereof, it will be understood that the various example embodiments are intended to be illustrative, not limiting. One of ordinary skill in the art will understand that various changes in form and details may be made therein without departing from the true spirit and full scope of the disclosure, including the appended claims.

What is claimed is:

1. A speaker module comprising:

a yoke defining one surface of the speaker module;

a magnet attached to the yoke through a first surface of the magnet;

a plate attached to a second surface of the magnet;

a frame providing a lateral surface of the speaker module and combined with the yoke at a first end of the frame;

a voice coil disposed to be spaced apart from the magnet; and a diaphragm combined with the voice coil at an inner surface of the diaphragm, wherein at least one of the yoke, the magnet, the plate, and the frame includes at least a portion of an air adsorption member comprising an air adsorption material configured to adsorb air in a space formed between the yoke, the diaphragm and the frame based on the diaphragm vibrating and at least one surface of the air adsorption member is in contact with the air in the space.

2. The speaker module of claim 1, wherein the air adsorption member is combined with at least a portion of the yoke, the magnet, the plate, and the frame.

3. The speaker module of claim 2, wherein the air adsorption member has at least one surface in contact with the air.

4. The speaker module of claim 1, wherein the air adsorption member comprises an air adsorption material applied to a sheet, and wherein the air adsorption material has a molecular structure including particles and binders configured to perform positive and negative adsorptions of air.

5. The speaker module of claim 1, wherein the air adsorption member is attached to an inner surface of the frame and the yoke without being contact with the voice coil.

6. The speaker module of claim 1, wherein at least a portion of the air adsorption member is combined with an outer surface of the plate.

7. The speaker module of claim 1, wherein at least a portion of the air adsorption member is included in at least a portion of the magnet and at least a portion of the plate.

8. The speaker module of claim 1, wherein the diaphragm includes at least one convex portion, at least a portion of the plate includes the air adsorption member, and the air adsorption member includes at least one protrusion at a position corresponding to the at least one convex portion.

9. The speaker module of claim 1, wherein the yoke includes a first hole and a second hole.

10. The speaker module of claim 9, wherein the air adsorption member is combined with an upper surface of the yoke, the first hole, and the second hole.

11. The speaker module of claim 9, wherein a first ventilation mesh is disposed over the first hole, and a second ventilation mesh is disposed over the second hole.

12. The speaker module of claim 11, wherein the first ventilation mesh and the second ventilation mesh include the air adsorption member.

13. The speaker module of claim 11, wherein a first space is provided between the first ventilation mesh and the diaphragm, a second space is provided between the second ventilation mesh and the diaphragm, and a third space is provided between the plate and the diaphragm.

14. The speaker module of claim 13, wherein the air adsorption member is combined with at least a portion of the frame disposed in the first space and with at least a portion of the frame disposed in the second space.

15. An electronic device comprising:

a housing providing at least a part of a lateral surface of the electronic device; and a speaker module accommodated in the housing, wherein the speaker module includes:

a yoke defining one surface of the speaker module;

a magnet attached to the yoke through a first surface of the magnet;

a plate attached to a second surface of the magnet;

a frame providing a lateral surface of the speaker module and combined with the yoke at a first end of the frame;

a voice coil disposed to be spaced apart from the magnet; and a diaphragm combined with the voice coil at an inner surface of the diaphragm, wherein at least one of the yoke, the magnet, the plate, and the frame is combined with at least a portion of an air adsorption member comprising an air adsorption material configured to adsorb air in a space formed between the yoke, the diaphragm and the frame based on the diaphragm vibrating and at least one surface of the air adsorption member is in contact with the air in the space.

16. The electronic device of claim 15, wherein at least a portion of the yoke, the magnet, the plate, and the frame includes at least a portion of the air adsorption member.

17. The electronic device of claim 16, wherein the air adsorption member has at least one surface in contact with the air.

18. The electronic device of claim 15, wherein the air adsorption member comprises an air adsorption material applied to a sheet, and wherein the air adsorption material has a molecular structure including particles and binders configured to perform positive and negative adsorptions of air.

19. The electronic device of claim 15, wherein the yoke includes a first hole and a second hole, wherein a first ventilation mesh is disposed over the first hole, and a second ventilation mesh is disposed over the second hole, and wherein the first ventilation mesh and the second ventilation mesh include the air adsorption member.

20. The electronic device of claim 15, wherein at least a portion of the air adsorption member is included in at least a portion of the magnet and at least a portion of the plate.

* * * * *